US007007826B2

(12) United States Patent
Shapanus et al.

(10) Patent No.: US 7,007,826 B2
(45) Date of Patent: Mar. 7, 2006

(54) PORTABLE FLUID DISPENSER AND METHOD

(75) Inventors: Christopher J. Shapanus, Laguna Hills, CA (US); Brian A. Babson, Fountain Valley, CA (US); Joiee Lee Puckett, Jr., Long Beach, CA (US)

(73) Assignee: SHURflo Pump Manufacturing Company, Inc., Cypress, CA (US)

( * ) Notice: Subject to any disclaimer, the term of this patent is extended or adjusted under 35 U.S.C. 154(b) by 0 days.

(21) Appl. No.: 10/617,488

(22) Filed: Jul. 11, 2003

(65) Prior Publication Data

US 2005/0006400 A1 Jan. 13, 2005

(51) Int. Cl.
*B67D 5/64* (2006.01)

(52) U.S. Cl. ..... 222/175; 222/333; 222/385; 239/152; 239/153

(58) Field of Classification Search ..... 222/175, 222/1, 333, 385, 63, 626, 382; 239/152–154, 239/332; 417/234; 248/374, 674
See application file for complete search history.

(56) References Cited

U.S. PATENT DOCUMENTS

| | | | | |
|---|---|---|---|---|
| 2,958,155 A | | 11/1960 | Emmerich | |
| 3,320,895 A | * | 5/1967 | Peterson et al. | 417/319 |
| 3,421,697 A | * | 1/1969 | Marks | 239/152 |
| 3,901,449 A | * | 8/1975 | Bochmann | 239/332 |
| 4,618,099 A | | 10/1986 | Nagao et al. | |
| 4,651,903 A | | 3/1987 | Pagliai | |
| 4,801,088 A | | 1/1989 | Baker | |
| 4,925,105 A | | 5/1990 | Lin | |
| 5,150,837 A | | 9/1992 | Ferrari | |
| 5,636,791 A | * | 6/1997 | Leer | 239/142 |
| 5,752,661 A | | 5/1998 | Lewis | |
| 5,785,245 A | | 7/1998 | Tedders, Jr. et al. | |
| 6,094,773 A | * | 8/2000 | Krentz et al. | 15/321 |

OTHER PUBLICATIONS

SP Systems, SP1 Backpack Sprayer, publicly disclosed prior to Jul. 11, 2003.
Birchmeier, Accu 15-2000 Backpack Sprayer with Rechargeable Battery, publicly disclosed prior to Jul. 11, 2003.
Selecta, Knapsack Sprayer with a Battery and Charger, publicly disclosed prior to Jul. 11, 2003.
SP Systems, SP5000E Electric Backpack Sprayer, publicly disclosed prior to Jul. 11, 2003.
Berthoud, Vermorel 2000 Electrick Knapsack Sprayer, publicly disclosed prior to Jul. 11, 2003.
Volpi and Bottoli, Battery Operated Knapsack Sprayer, publicly disclosed prior to Jul. 11, 2003.
Fox Motori, F200 Knapsack Recharageable Power Sprayer, publicly disclosed prior to Jul. 11, 2003.
Originale Volpi, publicly disclosed prior to Jul. 11, 2003.

* cited by examiner

*Primary Examiner*—Frederick Nicolas
(74) *Attorney, Agent, or Firm*—Michael Best & Friedrich LLP

(57) ABSTRACT

In some embodiments, a portable fluid dispenser is provided having a tank, a pump coupled to the tank for pumping fluid therefrom, and a battery connected to the tank for powering the pump. The battery can be part of a removable battery pack received within an external receptacle of the tank. Some embodiments of the dispenser are adapted to be worn (such as in the form of a backpack), while others are adapted to be carried by a user. Also, in some embodiments a conduit extends through the tank in order to enable fluid to pass from the pump to another location with respect to the tank.

30 Claims, 18 Drawing Sheets

PORTABLE FLUID DISPENSER AND METHOD

FIELD OF THE INVENTION

The present invention generally relates to fluid dispensers and fluid dispensing methods, and more particularly to portable fluid dispensers and fluid dispensing methods in which the fluid dispenser can be worn or carried by a user.

BACKGROUND OF THE INVENTION

Several varieties of portable fluid dispensers exist in today's marketplace, and are adapted for dispensing a wide variety of different fluids in numerous applications. For example, many such portable dispensers are fluid sprayers used to apply fluid to surfaces and objects, such as for spraying water, fertilizer, weed killer, pesticide, cleaning fluid, paint, lacquer, and any other fluid. In some cases, these portable fluid sprayers are adapted to be carried by a user from location to location as the needs of a project require. In these and other cases, portable fluid sprayers can be worn by a user, such as on a user's back in backpack form.

With reference to conventional backpack fluid sprayers for purposes of introduction only, some conventional backpack sprayers are hand pump sprayers, while other conventional sprayers are powered (such as by battery power or via a power cord to a power source). Electrical backpack sprayers typically include a tank having an internal chamber for containing fluid, a pump operable to pump fluid from the tank, a powering device (such as a battery or appropriate circuitry for a power connection) connected to the pump to power the pump, and a conduit connected to the outlet of the pump for passing fluid from the pump to a dispensing nozzle connected to an end of the conduit.

Each of these electrical backpack sprayers often include several other components, such as a support frame for engaging the ground and supporting the sprayer thereupon, metallic or plastic back frames with shoulder straps or other items for supporting the sprayer on a user's back, and many other design-specific components. Conventional electrical backpack sprayers containing some or all of these components (and/or still other components) are often heavy, thereby increasing user fatigue, and in some cases preventing some people from using the electrical backpack sprayer.

With continued reference to backpack sprayers for purposes of introduction only, some conventional backpack sprayers support the pump in an inconvenient location. More particularly, the pump outlet (to which the conduit and dispensing nozzle is connected) is often inconveniently positioned, thereby extending the tube out of the sprayer in an undesirable location. For example, some backpack sprayers have a fluid conduit extending from a front surface of the sprayer facing a wearer's back, from a bottom surface of the sprayer (which requires a frame or other structure of the sprayer to prevent damage to the fluid conduit), or from a location that requires an excessive amount of conduit in order for a user to properly orient the dispensing nozzle. Such sprayer designs can make a user uncomfortable, cause injury to the user or cause damage to the backpack sprayer.

Some conventional portable electrical sprayers use batteries as a source of power for the pump, and often require regular charging of the battery. Some of these battery powered backpack sprayers include a battery located within an internal compartment of the sprayer and connected directly to the pump with electrical connectors, and require that the battery be disconnected from the pump and removed from the sprayer in order to be charged. To access the internal compartment for this purpose, fasteners and a cover must normally be removed. This disconnection and removal of components can be a difficult and time consuming process. Components can also be misplaced or lost after disconnection and removal. In other battery powered sprayers, the battery can remain in the internal compartment, but the fasteners and cover must be removed and the battery must still be disconnected from the pump. This removal and disconnection again often proves to be a difficult and time consuming process.

In light of these and other shortcomings of conventional electrical backpack sprayers, there are increasing market demands for improved portable fluid dispensers. New portable fluid dispensers addressing one or more of such shortcomings would be a welcome addition to the art.

SUMMARY OF THE INVENTION

In some embodiments of the present invention, a portable backpack fluid dispenser operable to dispense fluid is provided, and comprises a tank defining a cavity in which fluid is supportable; a pump fluidly connected to the tank and having an inlet and an outlet, wherein fluid is pumpable from the cavity into the pump through the inlet and is pumpable out of the pump through the outlet; a dispensing tube in fluid connection with the outlet of the pump and being operable to pass fluid therethrough; and a conduit defined in the tank and at least partially passing through the cavity, wherein the dispensing tube is at least partially positioned in the conduit.

Some embodiments of the present invention also provide a method of dispensing fluid from a portable backpack fluid dispenser, wherein the method comprises providing a tank defining a cavity operable to support fluid therein, the tank having a conduit passing at least partially through the cavity; fluidly connecting a pump to the tank, the pump having an inlet and an outlet; providing a dispensing tube at least partially received within the conduit, the dispensing tube having an end fluidly connected to the outlet of the pump; pumping fluid from the tank into the pump through the inlet of the pump; and pumping fluid out of the pump and into the dispensing tube through the outlet of the pump.

In another aspect of the present invention, a portable backpack fluid dispenser operable to dispense fluid is provided, and comprises a tank operable to support fluid therein; a bracket connected to the tank; a pump connected to the bracket and including an inlet and an outlet, the pump being operable to pump fluid from the cavity into the inlet and pump fluid out of the pump through the outlet; and a cover selectively connectable to the bracket and being operable to at least partially cover the pump when connected to the bracket.

Some embodiments of the present invention also provide a method of assembling a portable backpack fluid dispenser operable to dispense fluid, wherein the method comprises providing a tank operable to support fluid therein; connecting a bracket to the tank; connecting a pump to the bracket, the pump being supportable by the bracket and being operable to pump fluid from the tank; and connecting a cover to the bracket, the cover being operable to at least partially cover the pump when connected to the bracket.

In another aspect of the present invention, a battery pack for an electrical backpack fluid dispenser is provided, and is selectively connectable to and removeable from the dispenser. The battery pack comprises a battery operable to provide electrical current to the dispenser to power the dispenser; and a cover selectively connectable to the battery and operable to support and cover the battery.

In some embodiments of the present invention, an electrical backpack fluid dispenser operable to dispense fluid is provided, and comprises a tank operable to support fluid therein and defining an external receptacle therein; a pump fluidly connected to the tank to pump fluid from the tank; and a battery pack selectively connectable to and removable from the tank, the battery pack including a battery selectively positionable within the receptacle and operable to provide electrical current to the pump to power the pump; and a cover selectively connectable to the battery and operable to at least partially cover the receptacle when the battery is positioned in the receptacle, the battery and cover being selectively connectable to and removeable from the tank together.

In yet another aspect of the present invention a method of assembling an electrical backpack fluid dispenser is provided, and comprises providing a tank operable to retain fluid therein, the tank defining a receptacle; fluidly coupling a pump to the tank, the pump operable to pump fluid from the tank; releasably coupling a battery to a cover to define a battery pack; inserting the battery into the receptacle; and releasably coupling the battery pack to the tank.

Some embodiments of the present invention provide an electrical backpack fluid dispenser operable to dispense fluid, the dispenser comprising a tank having an internal fluid chamber; a pump fluidly connected to the tank and operable to pump fluid from the tank; a battery coupled to the pump to power the pump; and an externally accessible electrical connector electrically coupled to the battery, the electrical connector adapted to be releasably coupled to a battery charger to charge the battery.

In some embodiments of the present invention, a method of assembling an electrical backpack fluid dispenser is provided, and comprises providing a tank operable to support fluid therein; providing a pump; fluidly connecting the pump to the tank to pump fluid from the tank; providing a battery operable to power the pump; removably coupling the battery to the tank; providing an externally accessible electrical connector in electrical communication with the battery for charging the battery; and electrically coupling the electrical connector to the pump.

More information and a better understanding of the present invention can be achieved by reference to the following drawings and detailed description.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION

Figure 2:
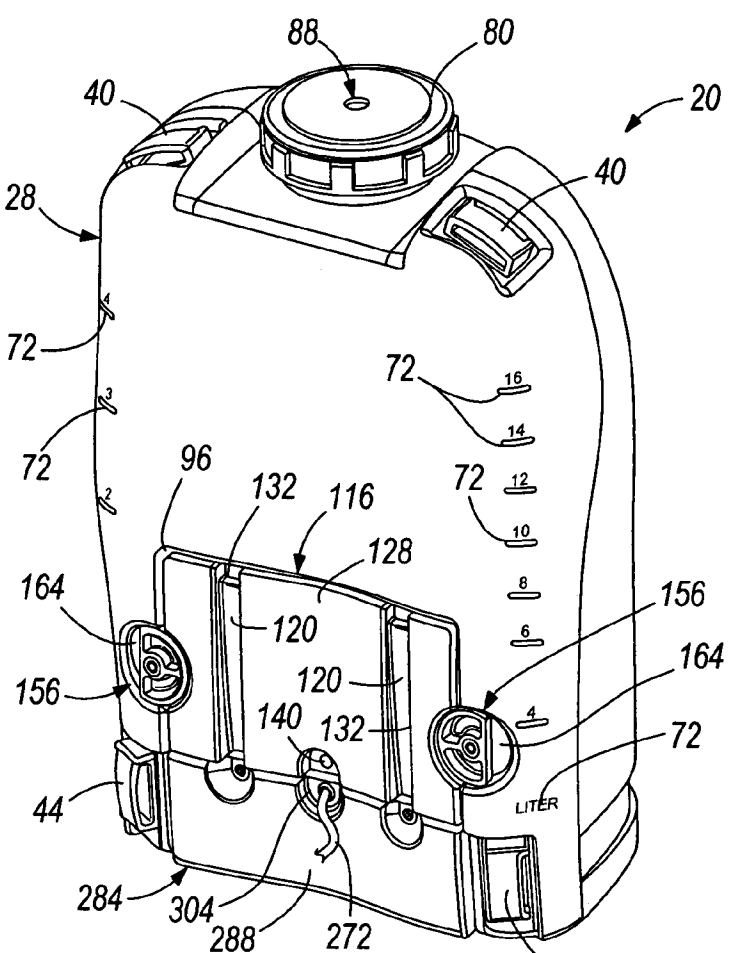
FIG. 2 is a front perspective view of the dispenser shown in FIG. 1, shown with a back support assembly removed.
Figure 1:
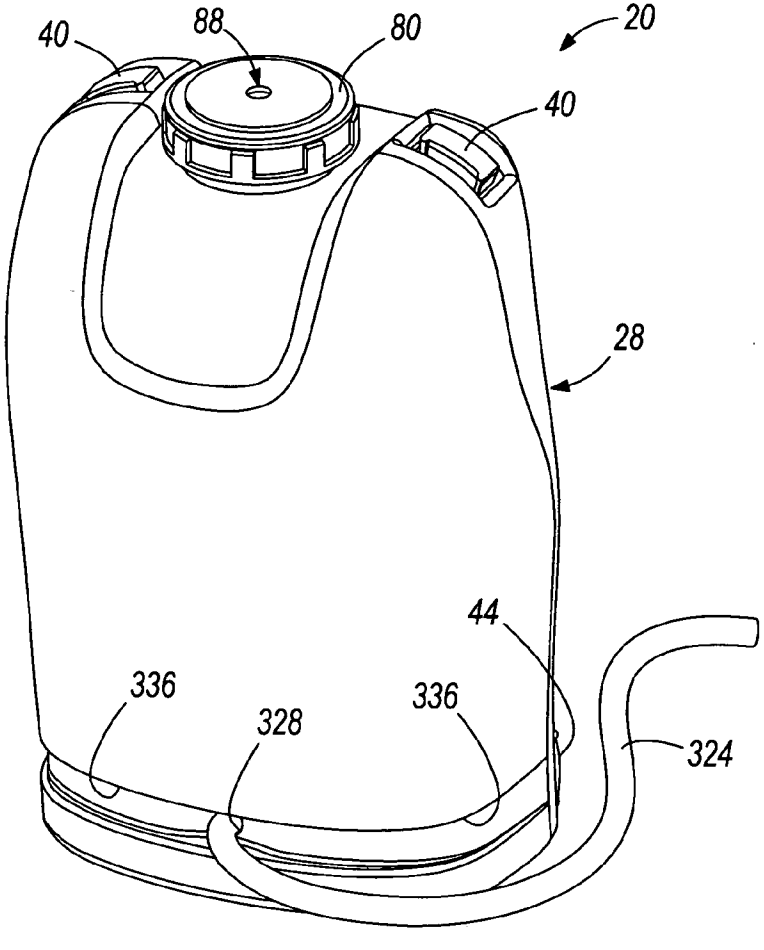
FIG. 1 is a rear perspective view of a portable fluid dispenser according to an exemplary embodiment of the present invention.
Figure 3:
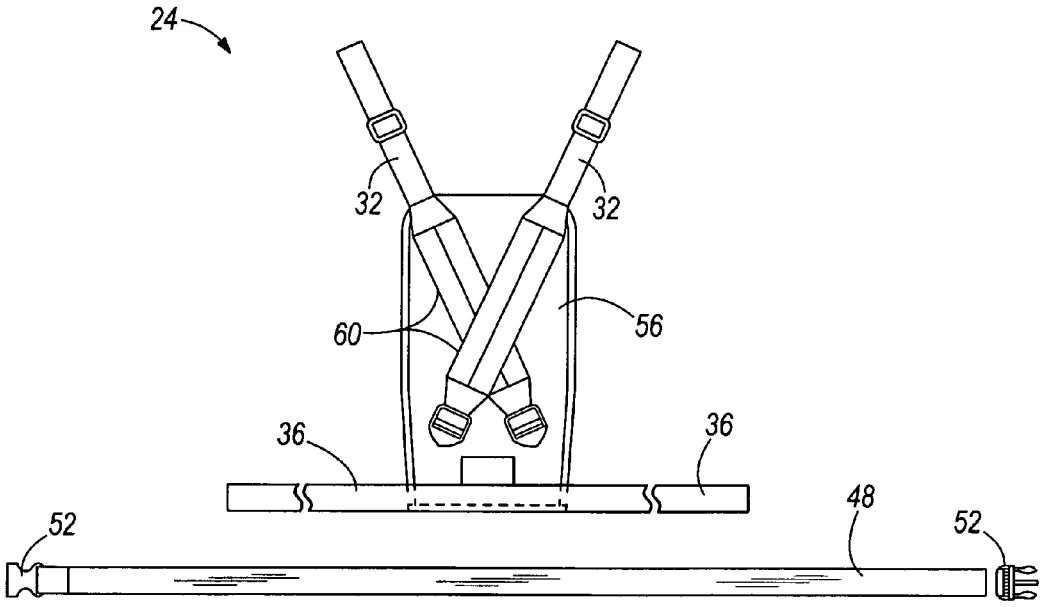
FIG. 3 is a front view of a back support assembly of the dispenser shown in FIG. 1.

Referring to FIGS. 1–2, an exemplary portable fluid dispenser 20 embodying the present invention is illustrated. The dispenser 20 of the present invention can be adapted to be worn and/or carried by a user, and can be powered or operated by hand using any conventional hand pump. The dispenser 20 can dispense a variety of fluids, such as, for example water, pesticide, weed killer, fertilizer, cleaning fluid, paint, lacquer, or any other appropriate fluid, in a variety of manners, such as, for example a steady stream, a dispersed spray, a mist, and/or in any other manner. The dispenser 20 illustrated in the figures and described in greater detail below is presented by way of example only to illustrate and describe the various features and elements of the present invention. In this regard, it should be noted that other embodiments of the present invention can employ any number of the features and elements illustrated in the figures and described in greater detail below.

Referring to FIGS. 1–6, the exemplary dispenser 20 is adapted to be worn by a user. Although the dispenser 20 can be adapted to be worn in any area of a user's body, the illustrated dispenser 20 is adapted to be worn on a back of a user. For this purpose, the dispenser 20 can include a back support assembly 24 positionable on the back of the user to support the dispenser 20. The back support assembly 24 in the illustrated embodiment is connected to a tank 28 of the dispenser 20, and can include upper straps 32 and lower straps 36 engageable with upper strap supports 40 and lower strap supports 44, respectively, of the tank 28 for connecting the back support assembly 24 to the tank 28. Any number of straps and strap supports can be employed to secure the back support assembly 24 to the tank 28, such as, for example only the upper straps 32 and upper strap supports 40 or more than the upper and lower straps 32, 36 and strap supports 44. Also, straps can be connected to the tank 28 in other manners, such as, by partially or completely wrapped straps around the tank, by fastening one or more straps to the tank 28 using any type of fastener, by bonding the straps to the tank 28 by gluing, melting or other type of bonding process, and the like.

In some embodiments, devices other than straps can be employed to connect the back support assembly 24 to the tank 28. By way of example only, one or more ropes or cords can connect the back support assembly 24 to the tank 28. The straps can be releasably connected to the tank 28 (e.g., via a back support assembly 24, through strap supports 40, 44, and the like), or can be permanently connected to the rest of the dispenser 20 by bonding, integrally forming or other types of permanent connections. Any part of the back support assembly 24 can be releasably or permanently secured to the tank 28 or other part of the dispenser 20 as desired.

In the illustrated embodiment, a waist belt 48 (see FIG. 3) is insertable through the lower strap supports 44 and can be wrapped around a user's waist to assist in the connection of the dispenser 20 to the user. A buckle 52 (see FIG. 3) is connected to the waist belt 48 and is operable to connect the waist belt 48 together to secure the belt 48 around a user's waist. Any other fastening devices or elements can instead be employed as desired for this purpose, including without limitation one or more snaps, clips, clamps, hooks, buttons, and the like. In some embodiments, the belt 48 or other straps 32, 36 can be wrapped around a user's arm or leg, over a shoulder, around a torso, or hips, or in any other manner providing support for the dispenser 20 upon the user.

Some embodiments of the back support assembly 24 also include a pad 56 to which one or more of the straps 32, 36 are connected. The pad 56 can therefore distribute the weight of the dispenser 20 to multiple locations on a user through the straps 32, 36. The pad 56 can have force absorbing characteristics (e.g., have one or more layers of cushioning material) in order to decrease the forces exerted upon a wearer by operation of the dispenser 20. Although other strap configurations can be employed, a pair of shoulder straps 60 are connected to the pad 56 in the illustrated exemplary embodiment, and are positionable over a user's shoulders to assist in supporting the dispenser 20 on the user's back. The shoulder straps 60 can include one or more pads to absorb forces that would otherwise be transferred to the user.

The straps 32, 36 can be attached to the rest of the dispenser 20 in any manner, such as by being passed through one or more strap supports 40, 44 as shown in the figures, by being wrapped around the tank 28 or other part of the dispenser 20, and the like. The dispenser 20 of the illustrated exemplary embodiment has upper and lower strap supports 40, 44 connected to the tank 28 through a molding process. In particular, the tank 28 is molded with the strap supports 40, 44 in location on the tank 28, thereby molding material of the tank walls around a portion of each strap support 40, 44. The strap supports 40, 44 can have any shape adapted for this purpose, such as one or more projections, lips, ledges, ribs, or other features about which material of the tank 28 can flow or otherwise cover when the tank 28 is manufactured. In the illustrated exemplary embodiment, the strap supports 40, 44 have projections 41 (see FIG. 6) extending toward the tank 28 and that are at least partially surrounded by material of the tank 28 when the tank 28 (made of plastic in some embodiments) is molded. By way of example only, the tank 28 can be blow-molded, injection-molded, cast, or formed in any other manner enabling material of the tank 28 to at least partially surround the supports 40, 44 (e.g., projections 41 of the supports 40, 44 in some embodiments). If employed, the projections 41 of the supports 40, 44 can take any shape desired, such as bulbed, barbed, or other shapes. In the illustrated embodiment, the projections 41 are dovetail shaped. By employing one or more projections 41 that have enlarged distal ends, the supports 40, 44 can be more securely attached to the tank 28.

In other embodiments, the upper and lower strap supports 40, 44 are connected to the tank 28 in a variety of other manners, such as, for example by one or more conventional fasteners, by adhesive or cohesive bonding material, by integrally forming the strap supports 40, 44 with the tank 28, by resilient snaps, bonding, welding, brazing, soldering, and the like. Each such alternative strap support 40, 44 connection falls within the spirit and scope of the present invention. By using the back support assembly 24 in the illustrated exemplary embodiment of the dispenser 20, no additional frame (e.g., a metallic or heavy plastic frame) is necessary, thereby resulting in a lighter and less expensive dispenser 20.

Figure 4:
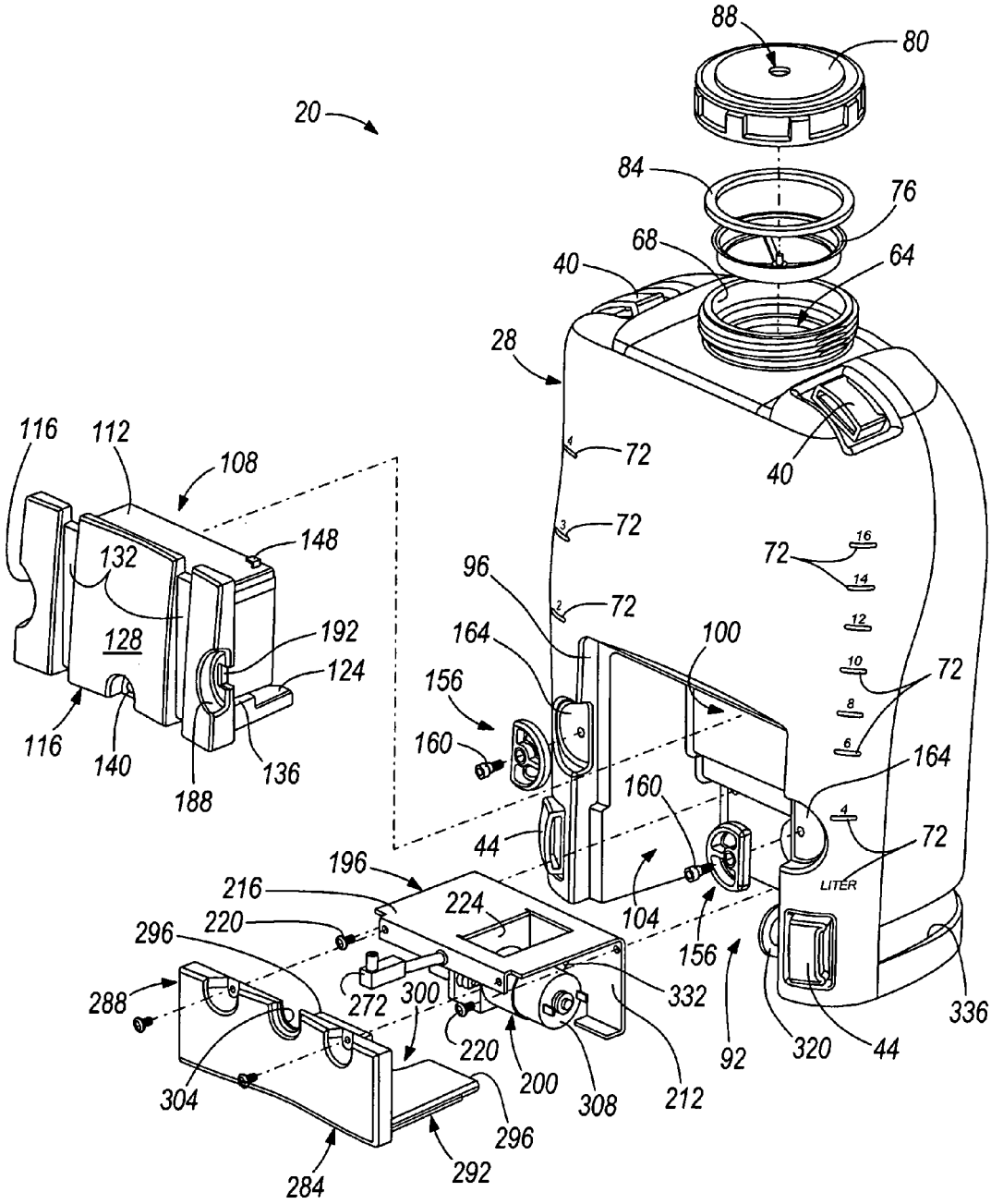
FIG. 4 is a partially exploded front perspective view of the dispenser shown in FIG. 1.
Figure 5C:
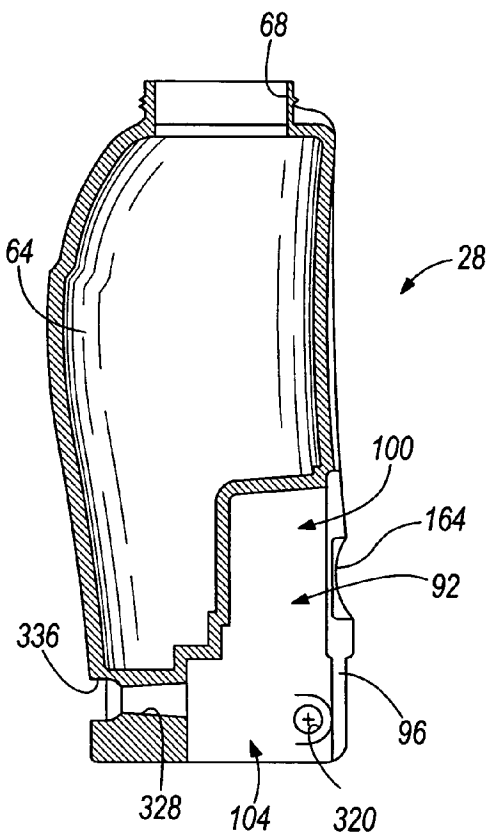
FIG. 5C is a cross-sectional view of the tank shown in FIG. 5A, taken along line 5C—5C in FIG. 5B.
Figure 5B:
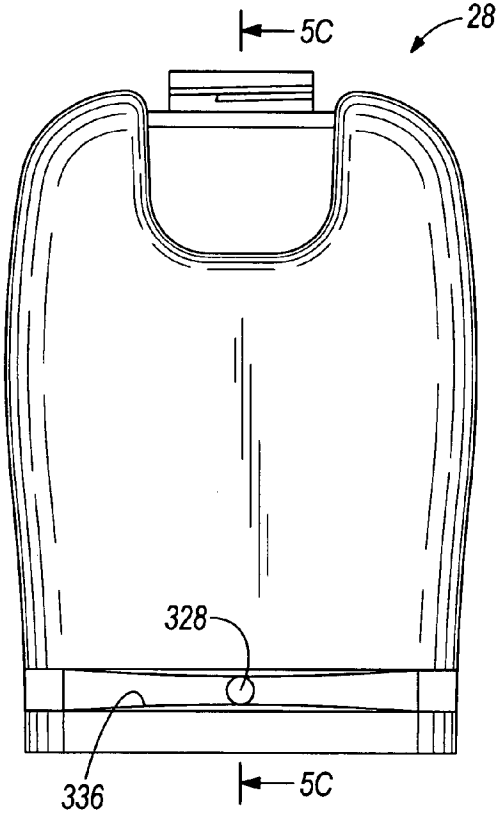
FIG. 5B is a rear view of the tank shown in FIG. 5A.
Figure 5A:
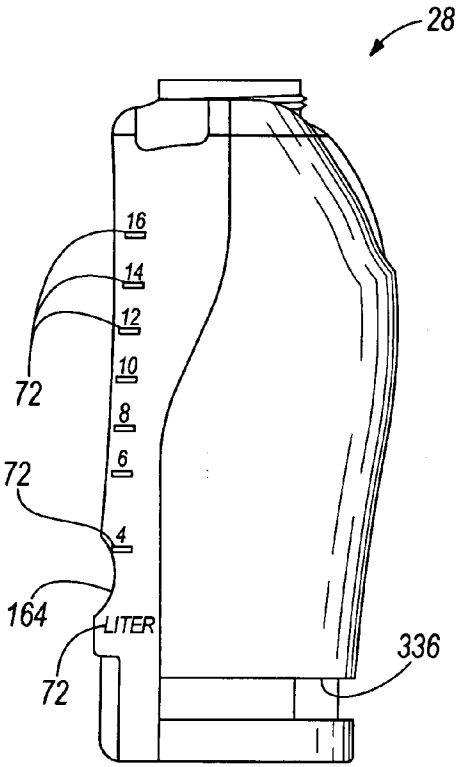
FIG. 5A is a right side view of a tank of the dispenser shown in FIG. 1.
Figure 6:
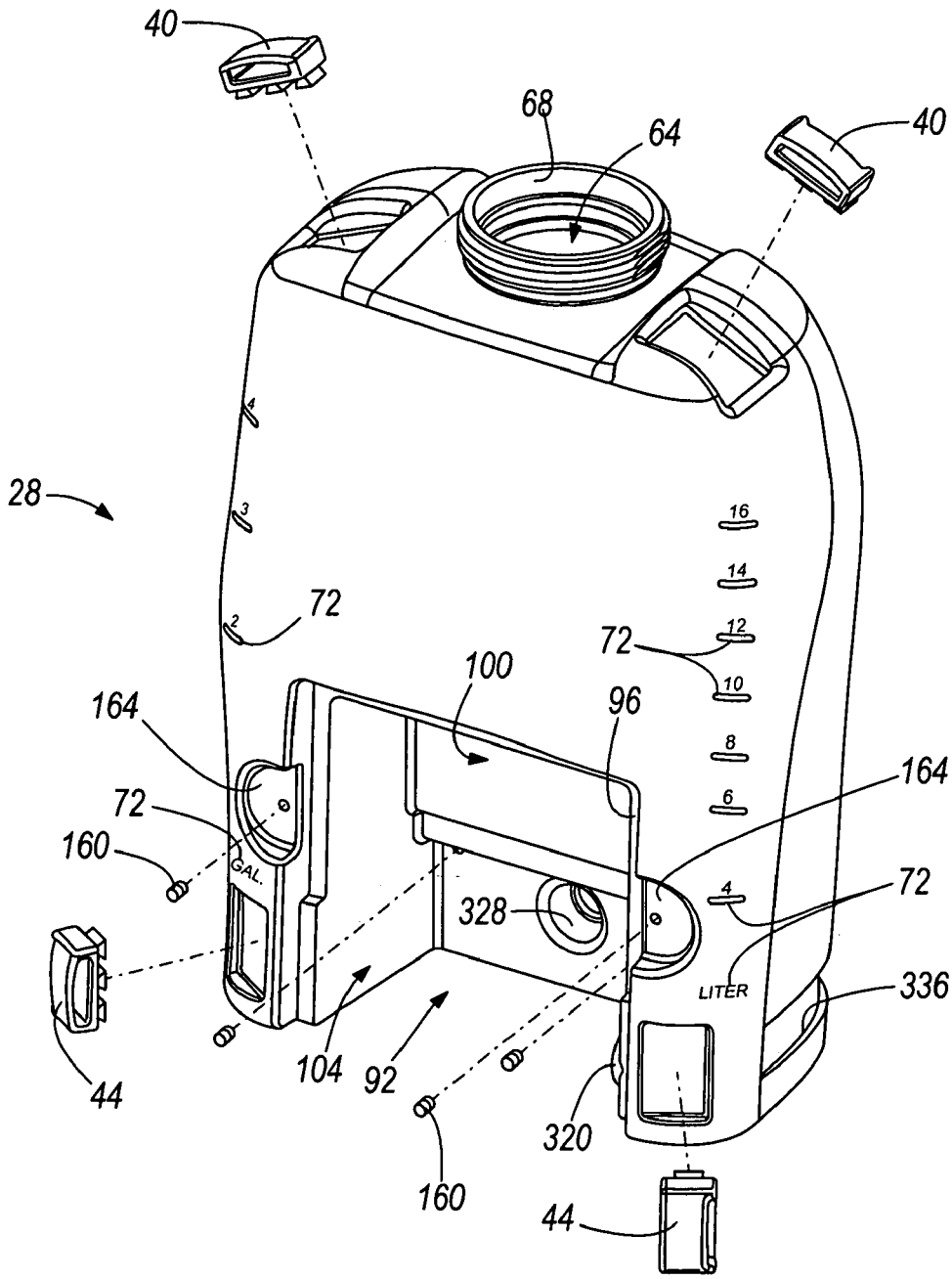
FIG. 6 is a partially exploded front perspective view of the dispenser shown in FIG. 1.
Figure 7:
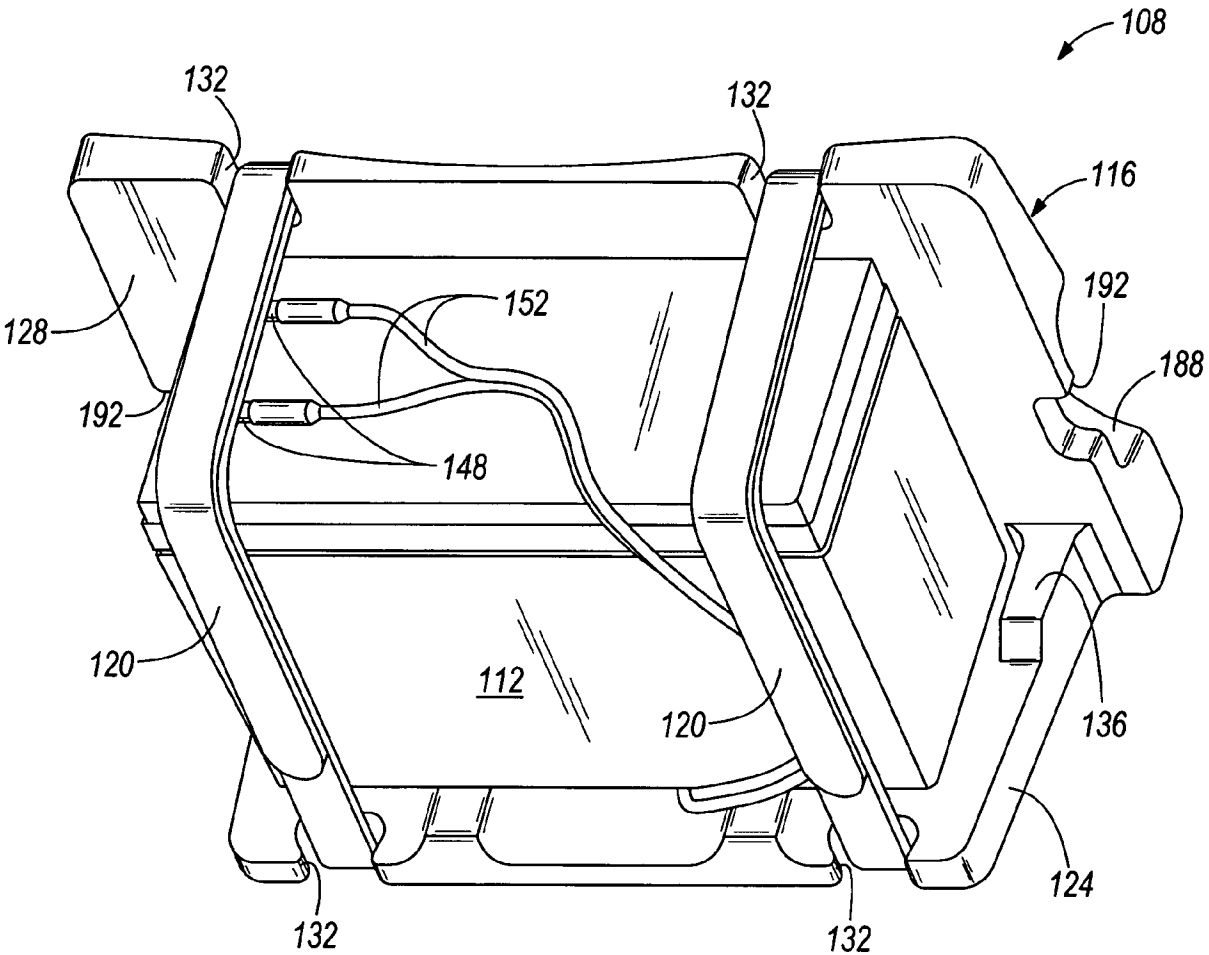
FIG. 7 is a rear perspective view of a battery pack of the dispenser shown in FIG. 1.
Figure 8:
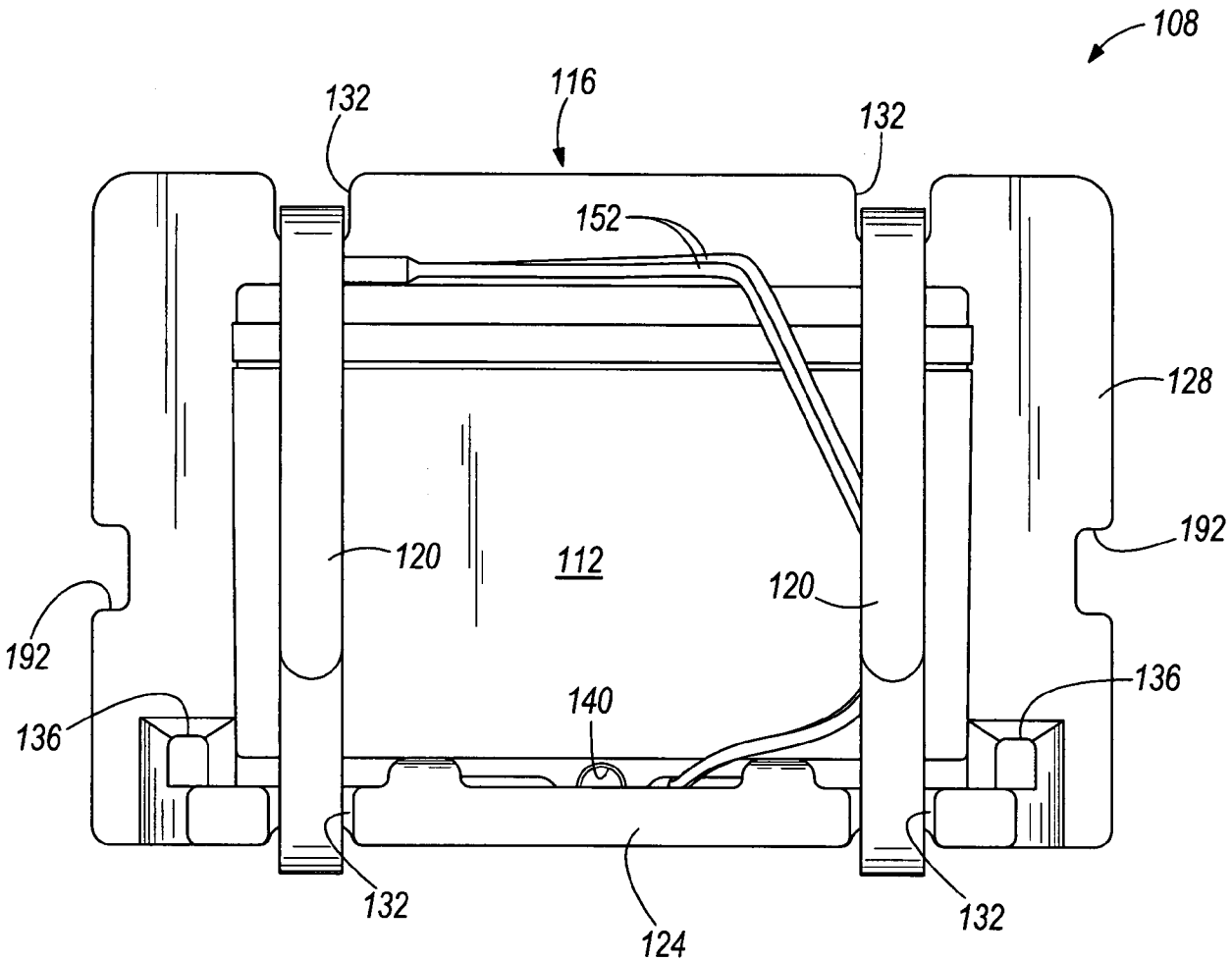
FIG. 8 is a rear view of the battery pack shown in FIG. 7.
Figure 9:
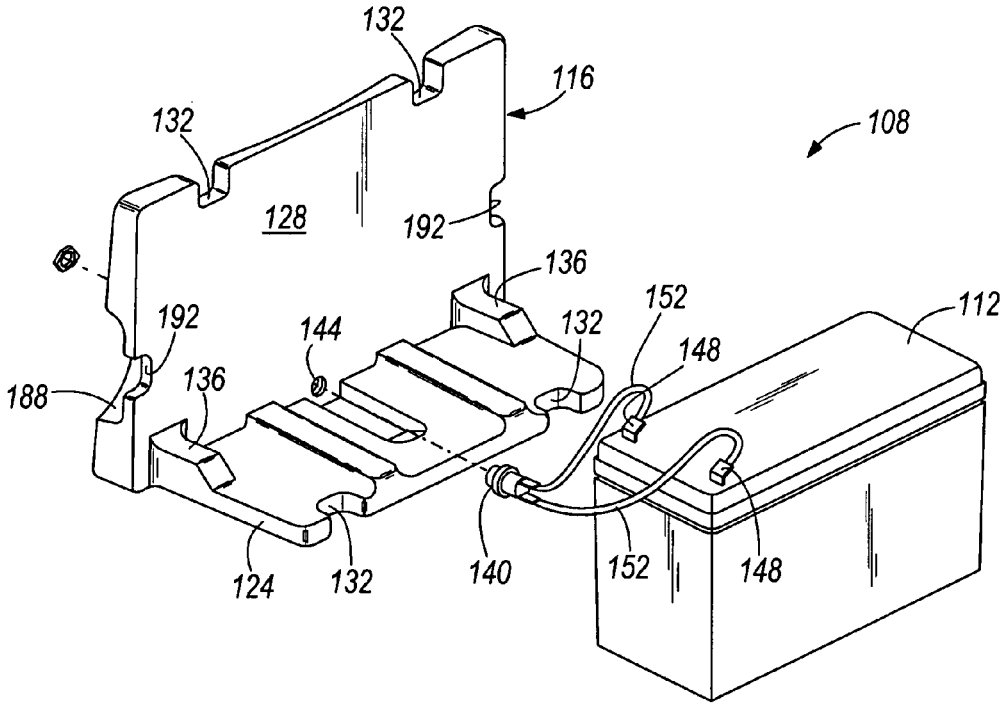
FIG. 9 is a partially exploded rear perspective view of the battery pack shown in FIG. 7, shown with the straps of the battery pack removed.
Figure 11:
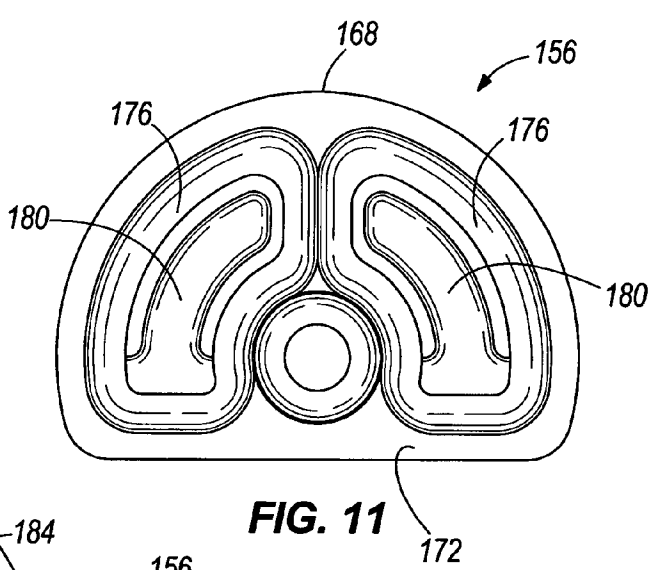
FIG. 11 is a front view of the latch shown in FIG. 10.
Figure 12:
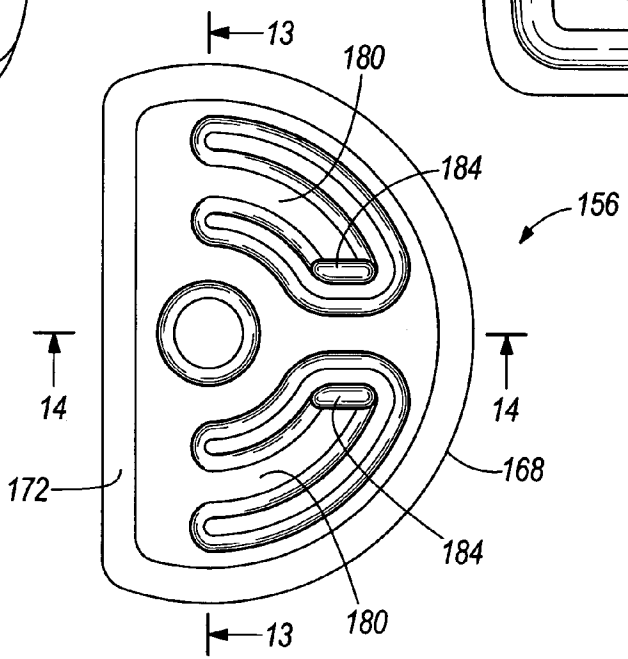
FIG. 12 is a rear view of the latch shown in FIG. 10.
Figure 10:
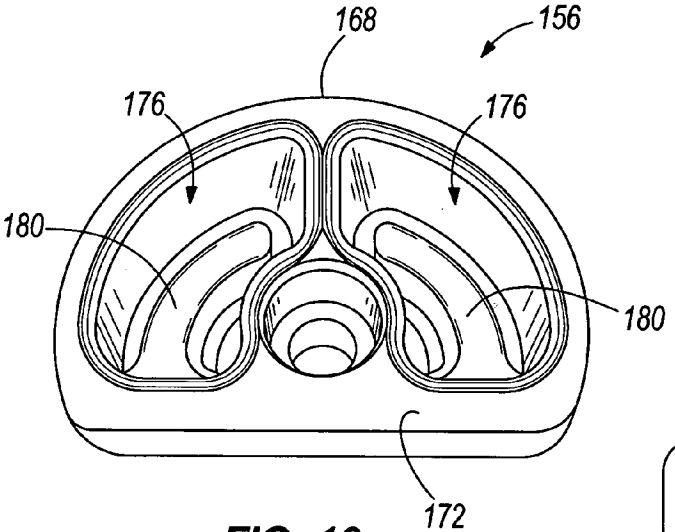
FIG. 10 is a front perspective view of a latch of the dispenser shown in FIG. 1.
Figure 15:
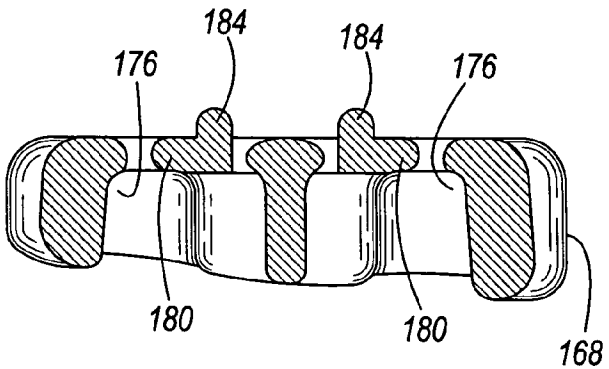
FIG. 15 is a cross-sectional view of the latch shown in FIG. 10, taken along line 15—15 in FIG. 14.
Figure 14:
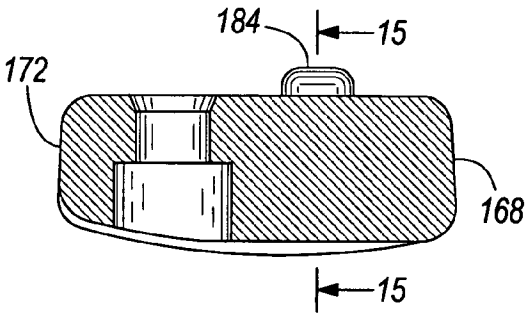
FIG. 14 is a cross-sectional view of the latch shown in FIG. 10, taken along line 14—14 in FIG. 12.
Figure 13:
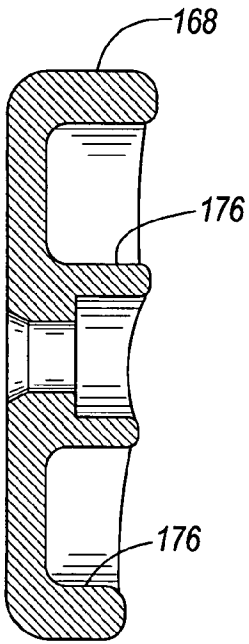
FIG. 13 is a cross-sectional view of the latch shown in FIG. 10, taken along line 13—13 in FIG. 12.

Referring to FIGS. 4–6, the tank 28 defines an internal cavity 64 in which fluid can be received and stored, and an opening 68 through which fluid can be placed into the tank 28 or removed from the tank 28. The opening 68 can be located in any portion of the tank 28, and is located in a top wall of the tank 28 as shown in FIGS. 4–6. If desired, a plurality of fluid level indicators 72 can be formed on an exterior surface of the tank 28 to indicate the amount of fluid contained within the tank 28. In the illustrated embodiment, the indicators 72 indicate fluid levels in both gallons and liters. Alternatively, the indicators 72 can indicate fluid levels in any other desired measuring unit. Also in the illustrated embodiment, the tank 28 is made at least partially of translucent plastic, thereby enabling the use of indicia on the tank for fluid level indicators. However, in other embodiments, the tank 28 can be made at least partially of opaque plastic, metal or other material, in which case any other type of fluid level indicator (float, glass or plastic tube, and the like) can be employed.

In some embodiment, a strainer 76 is removably positioned in the opening 68 and is operable to strain solids from fluid being transferred into the tank 28. In the illustrated embodiment, the opening 68 and the strainer 76 are substantially round and are complementarily sized to ensure proper straining of the fluid. The opening 68 and strainer 76 can alternatively be any other shape, such as, for example, rectangular, triangular, oval, irregular, and the like, as long as the opening 68 and strainer 76 are properly shaped and sized relative to one another to ensure proper straining of the fluid.

In some embodiments, a tank cover 80 is selectively connectable to the tank 28 over the opening 68 to seal the opening 68 and to prevent leakage of the fluid out of the opening 68. Likewise, the tank cover 80 is complementarily shaped and sized with the opening 68, and can assume any shape and size providing an effective seal between the tank cover 80 and the opening 68. If desired, a gasket 84 can be employed between the tank cover 80 and the strainer 76 or between the strainer 76 and the tank 28 to create an improved seal therebetween. Alternatively, a gasket 84 can be positioned between the tank 28 and the tank cover 80 when no strainer 76 is used. The dispenser 20 can be employed without the strainer 76 in those cases in which a user does not require straining of the fluid being received within the tank 28, or when the user desires to remove the strainer 76 after fluid received within the tank 28 has been strained through the strainer 76.

The tank cover 80 can include a vent assembly 88 operable to allow ventilation of the tank 28. Ventilation of the tank 28 can be desirable in order to prevent a vacuum from forming within the tank 28, which in some cases can have a detrimental impact upon performance of the dispenser 20. The vent assembly 88 can be provided with a spring-loaded plug for closure of a cover aperture under normal operating conditions (and for temporarily opening under sufficient suction from within the tank 28 to vent the tank 28 as needed). The vent assembly 88 is of a type known to those skilled in the art, and will not therefore be discussed in greater detail herein.

Referring now to the exemplary embodiment of FIGS. 1–9 (a battery-powered dispenser), the tank 28 defines a receptacle 92 in a front surface thereof. The receptacle 92 can include an upper portion 100 and a lower portion 104, and in some embodiments can include a lip 96 (described in greater detail below). The dispenser 20 also includes a battery pack 108 removably connected to the tank 28. The battery pack 108 can be removably connected in any manner, such as by one or more conventional fasteners, by a snap or tight fit into the receptacle 92, and the like. In the illustrated embodiment, the battery pack 108 is removably connected to the tank 28 with latches 156 (discussed in greater detail below).

The receptacle 92 can have any size and shape sufficient to receive at least the battery pack 108 therein. In the illustrated embodiment, the receptacle 92 is larger than the battery pack 108 in order to also house the pump 200 and other components of the dispenser 20. In such cases, the battery pack 108 can be located anywhere in the receptacle 92, and in the illustrated embodiment is located in an upper portion 100 of the receptacle 92.

The battery pack 108 includes a battery 112 and a battery cover 116. In the illustrated embodiment, the battery 112 is a high capacity 12-volt battery. However, the battery 112 can be any type of battery operable to effectively power the dispenser 20. Also in the illustrated embodiment, the battery 112 is removably connected to the battery cover 116 with Velcro straps 120 (see FIG. 7). Alternatively, the battery 112 can be mounted to the battery cover 116 in other manners, such as, for example, by one or more fasteners (screws, bolts, clamps, pins, and the like), by integrally forming the battery with the battery cover 116, by snap fit connection to the battery cover 116, by inter-engaging elements or features of the battery 112 and battery cover 116 (mating clips, projection and aperture sets, and the like), by welding, brazing, or soldering, by adhesive or cohesive bonding material, by other types and arrangements of straps, and the like. Regardless of the manner in which the battery 112 is mounted to the battery cover 116, the battery pack 108 defined at least in part by the battery 112 and battery cover 116 can define an assembly that can be installed in and removed from the rest of the dispenser 20 as a unit.

In some embodiments, the battery cover 116, strap supports 40, 44, and/or the latches 156 are at least partially recessed within walls of the tank 28, thereby providing a smoother exterior of the dispenser 20. In some cases, the battery cover 116, strap supports 40, 44, and/or the latches 156 have an exterior surface (when installed on the dispenser) substantially matching the contour of the surrounding surface of the tank 28. By way of example only, the battery cover 116 and the pump cover 284 (described in greater detail below) of the illustrated exemplary embodiment have a bowed shape, presenting a concave surface to the exterior of the dispenser 20. This shape follows the contour of adjacent surfaces of the tank 28, and provides a more comfortable fit upon a user's back.

The battery cover 116, strap supports 40, 44, and/or the latches 156 can be recessed into walls of the tank 28 by one or more depressions or recesses defined in the exterior of the tank 28. For example, the lip 96 of the tank 28 in the illustrated embodiment is defined in the front surface of the tank 28, and has a depth sufficient to receive the battery cover 116 and to support the battery cover 116 in a recessed position with respect to the front surface of the tank 28. If the dispenser 20 is worn by a user, this recessed position reduces or substantially eliminates projections defined by edges or other parts of the battery cover 116. As another example, the latches 156 (described in greater detail below) in the illustrated embodiment are recessed within the front surface of the tank 28 in at least one rotational position of the latches 156. Similarly, the strap supports 40, 44 in the illustrated embodiment are recessed with respect to surrounding portions of the tank walls.

The battery cover 116 can be any shape and size, defining one or more walls of the dispenser 20 while closing that part of the receptacle 92 housing the battery 112. For example, the battery cover 116, can be substantially flat or panel-shaped, L-shaped, or V-shaped, or can have any other shape desired (with or without a contour as described above). In the illustrated exemplary embodiment, the battery cover 116 is substantially L-shaped and includes a base 124 and an upright wall 128 relatively positioned to at least partially cradle the battery 112 and to define at least part of the front and bottom walls of the dispenser 20 when installed therein.

In some embodiments, the battery cover 116 is provided with recesses 132 in which the straps 120 (if employed) can be received. The recesses in the illustrated battery cover 116 are located in the exterior surface of the base 124 and the upright wall 128. The straps 120 are positionable within the recesses 132 in order to retain the straps 120 in place with respect to the battery cover 116 and battery 112. In some embodiments, when the battery pack 108 is assembled, the battery 112 is vertically supported on the base 124 and is laterally supported by the upright wall 128, the straps 120, and side supports 136 extending upward from the base 124. In other embodiments, the battery cover 116 supports the battery 112 in other manners (e.g., only on a side of the battery 112, on multiple sides and from beneath the battery 112, and the like).

With particular reference to FIGS. 2 and 4 the battery pack 108 can also include a multi-purpose electrical connector 140 for connection to a battery charger (not shown) and for connection to electrical components of the dispenser 20 powered by the battery 112. In some embodiments, the connector 140 is located in a connector aperture 144 of the battery cover 116, such as the connector aperture 144 illustrated in FIGS. 2 and 4. The connector 140 can be externally accessible on the dispenser, enabling a user to disconnect and reconnect the connector 140 from a battery charger without removing the battery 112 or the battery cover 116 and without partial disassembly of the dispenser 20. The connector 140 is electrically connected to terminals 148 of the battery 112 via electrically conductive wires 152. In the illustrated embodiment, the connector 140 is a female-type jack operable to receive complementary male-type plugs. Alternatively, the connector 140 can be any other power connector, such as, for example a male connector, a multi-pin or multi-post connector, and the like.

As mentioned above, in some embodiments one or more latches are employed to retain the battery 112 (and the battery pack 108) in the dispenser 20. Referring to FIGS. 2, 4–6 and 10–15 by way of example only, a pair of latches 156 are rotatably connected to the tank 28 and are operable to releasably connect the battery pack 108 to the tank 28 in the upper portion 100 of the receptacle 92. Alternatively, the latches 156 can be mounted to the battery cover 116. In the illustrated exemplary embodiment, the latches 156 are connected to the tank 28 with fasteners 160, and rotate thereabout between a locked position (see FIGS. 2 and 4), in which the latches 156 connect the battery pack 108 to the tank 28, and an unlocked position (not shown), in which the latches 156 do not connect the battery pack 108 to the tank 28. It should be understood that any number (including one) of latches 156 can be used to releasably connect the battery pack 108 to the tank 28.

Both of the exemplary latches 156 illustrated in the figures are similar in structure and operation. Accordingly, only one of the latches 156 will be discussed in greater detail herein. The latch 156 can be positioned within a latch recess 164 defined in the tank 28, thereby placing the latch 156 in an orientation to at least partially match the contour of the front surface of the tank 28 (discussed in greater detail below) when the latch 156 is in the locked position. The latch 156 can have any shape desired, such as round, rectangular, oval, elongated, irregular, shapes, and can be attached to rotate to and from a position covering the edge of the battery cover 116 in a locked state. For example, a round latch can be pivotably secured to the tank 28 in an off-center position of the latch (thereby permitting the movement just described). As another example, and with reference to the illustrated exemplary embodiment, the latch 156 can be generally semi-disc shaped (e.g., having an arched edge 168 and a straight edge 172).

Regardless of the shape of the latch 156, the latch 156 can also have one or more tab cavities 176 each having a resilient tab 180 positioned therein and moveable relative to the rest of the latch 156. The free end of each tab 180 can include a tab protrusion 184 extending in a direction toward the tank 28. When employed in the latch 156, the tab 180 can function like a leaf spring, biasing the free end of the tab 180, the tab protrusion 184, or another portion of the tab 180 against an adjacent element (e.g., the exterior wall of the tank 28 or battery cover 116 in the illustrated embodiment) in order to provide resistance of the latch 156 to pivoting.

It should be noted that other types of latches or latching devices can be used in place of the latches 156 described above and illustrated herein. For example, a sliding latch can be used to selectively connect the battery pack 108 to the tank 28. Alternatively, a flip latch having a rotatable gate member connected to either the tank 28 or the battery pack 108 can releasably engage a loop or hook member on the battery pack 108 or tank 28, respectively. In such cases, a pin, rod, clip, or other element can be placed through the loop or hook member to retain the engagement with the rotatable gate member, if desired. Any other conventional latch and latching devices can be employed to releasably lock the battery pack 108 to the tank 28, and falls within the spirit and scope of the present invention.

When the battery pack 108 is positioned within the receptacle 92 and the latches 156 are in their locked positions, the arched edges 168 of the latches 156 are positioned within a latch recess 188 defined in the exterior of the upright wall 128 of the battery cover 116 and the tab protrusions 184 are positioned within an aperture 192 defined in the upright wall 128. The tab protrusions 184 extend sufficiently rearward to position themselves behind a front surface of the aperture 192, thereby causing the tab protrusions 184 to engage edges of the aperture 192 when the latch 156 is rotated. It should be understood that the latches 156 need not necessarily be received within latch recesses 188 defined in the battery cover 116. Also, the tab protrusions 184 need not necessarily be received in apertures 192 to lock the battery pack 108 to the tank 28. In this regard, the latches 156 can frictionally engage the battery cover 116 to retain the battery cover 116 in place. In such frictional engagements connections, the latches 156 need not necessarily have one or more tab protrusions 184, relying instead upon frictional engagement between the underside of the latches 156 and a surface of the battery cover 116. Also, and as mentioned above, the latches 156 can be mounted on the battery cover 116 for releasable engagement with adjacent portions of the tank 28 in any of the manners just described.

The latch 156 in the illustrated embodiment is rotatable in either a clockwise or counter-clockwise direction to move the latch 156 between locked and unlocked positions and to facilitate removal and replacement of the battery pack 108 with respect to the receptacle 92. With reference to the latches 156 illustrated in the figures and described above, upon latch rotation to the locked position shown in FIGS. 2 and 4, the tab protrusions 184 are resiliently biased into engagement with the aperture 192, and resist further rotation by engagement with the edges of the aperture 192. With forced rotation, however, the tab protrusions 184 are forced to retract out of the aperture 192, enabling the latches 156 to be rotated to their unlocked positions (rotated 180 degrees from the positions illustrated in FIGS. 2 and 4).

Figure 16:
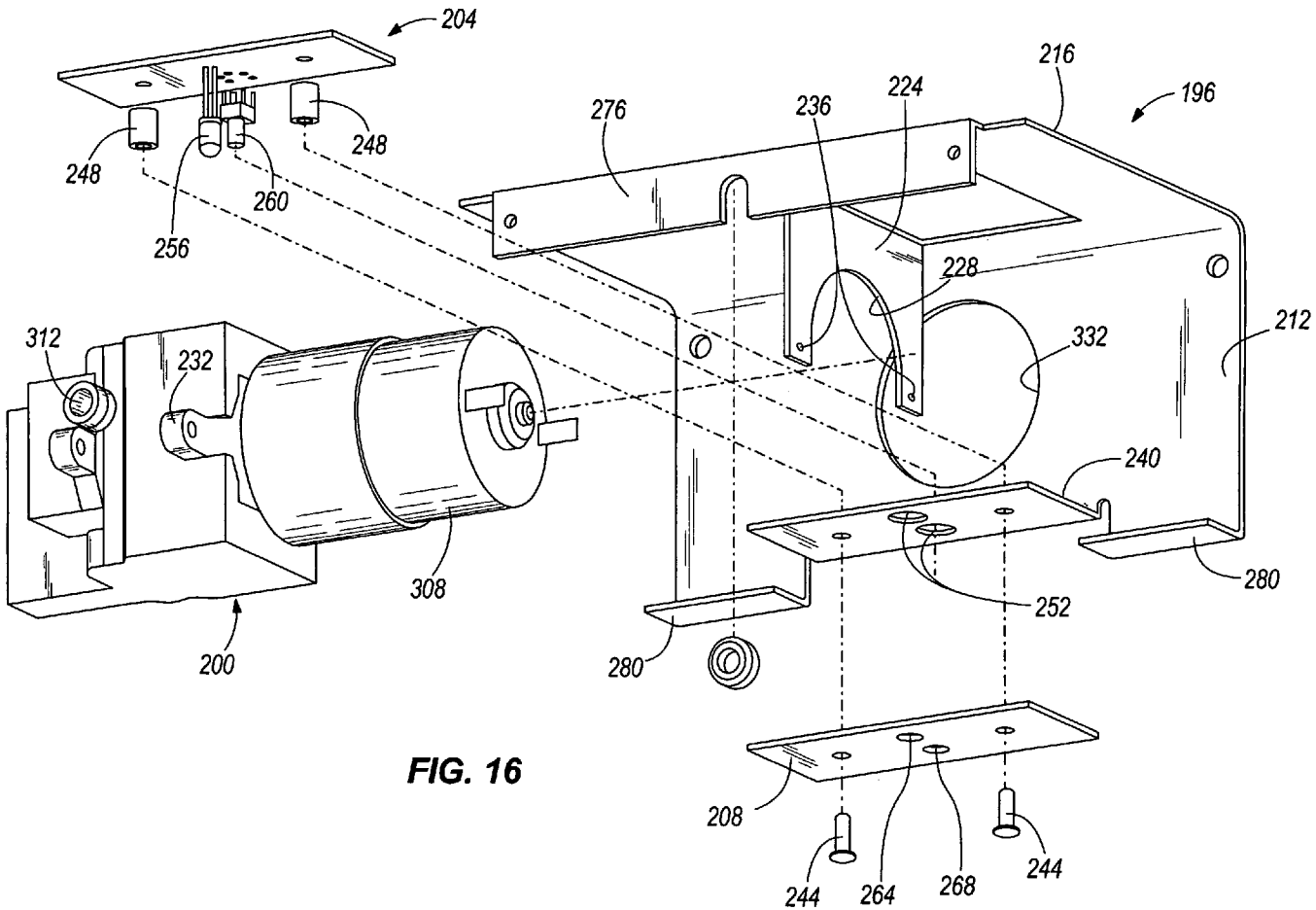
FIG. 16 is an exploded perspective view of a support bracket, a pump and a control assembly of the dispenser shown in FIG. 1.

Referring to FIGS. 4, 6 and 16, some embodiments of the present invention include a support bracket 196 employed to secure the pump 200 and other components of the dispenser 20 in place. In some embodiments, the support bracket 196 supports the pump 200 as well as a circuit board 204 and/or a user manipulatable control 208. The support bracket 196 can be located anywhere on the dispenser, 20, and in some embodiments is located within the receptacle 92 described above. By way of example only, the support bracket 196 illustrated in the figures is secured within the lower portion 104 of the receptacle 92 via conventional fasteners (e.g., rivets, screws, bolts, and the like). Alternatively, the support bracket 196 can be mounted within the receptacle 92 in any other manner, such as by molding or heat staking the bracket 112 to the tank 28 or by mounting the bracket 112 in any of the manners described above with reference to the connection between the battery 112 and the battery cover 116.

The bracket 196 can have any shape capable of securing the pump 200 (and other components, as described above) with respect to the tank 28. An exemplary bracket 196 is illustrated in FIGS. 4 and 16, and includes a first portion 212 and a second portion 216 extending substantially perpendicularly from the first portion 212. Although other bracket orientations are possible, the first portion 212 in the illustrated embodiment is substantially vertical, while the second portion 216 is substantially horizontal. The first portion 212 is connected to a rear of the lower portion 104 of the receptacle 92 with fasteners 220 as described above.

The bracket 196 can also include a third portion 224 positioned and oriented to provide a mounting surface for the pump 200 and/or a motor 308 employed to drive the pump 200. In the illustrated embodiment, the bracket 196 is integrally formed with one of the portions 212, 216 of the bracket 196 (e.g., the first portion 212), and depends downwardly to define a pump flange 224 to which the pump 200 is connectable. In the illustrated embodiment, the pump flange 224 extends substantially perpendicularly downward from the horizontal portion 216 of the bracket 196, although other orientations are possible for the pump flange 224. In some alternative embodiments, the pump flange 224 is connected to the rest of the bracket 196 in other manners, including the manners described above with reference to the manners in which the bracket 196 can be mounted.

In some embodiments, the pump flange 224 includes a recess or aperture 228 in which a portion of the pump 200 and/or motor 308 is receivable when the pump 200 and/or motor 308 is connected to the pump flange 224. In the illustrated embodiment for example, pump flange 224 has a recess 228 complementarily shaped to the portion of the pump 200 that will be received therein. The recess 228 can alternatively take any shape either complementarily or non-complementarily to the shape of the portion of the pump 200 and/or motor 308. The pump 200 can be mounted to the pump flange 224 in any conventional manner, such as by fasteners (not shown) that insert through mounting flanges 232 of the pump 200 and apertures 236 defined in the pump flange 224.

In order to provide a mounting location for the circuit board 204, some embodiments of the bracket 196 further include a control support member 240. The control support member 240 can be defined by a flange of the bracket 196 or can be attached to the bracket 196 in manners similar to the pump flange 224 described above. The control support member 240 can extend in any orientation as needed for mounting the circuit board 204 in a desired location and orientation on the dispenser 20. By way of example only, the control support member 240 in the illustrated embodiment is a flange of the bracket 196 extending substantially perpendicular from the vertical portion 212, wherein the circuit board 204 is connected to a top side of the control support member 240. If desired, electrically insulative spacers 248 can separate the circuit board 204 from the bracket 196.

The dispenser 20 of the present invention can also include a control pad 208 for controlling operation of the dispenser 20. This control pad 208 can be located anywhere on the dispenser 20. For example, the control pad 208 can be located on the bottom, side, or top of the dispenser 20, and/or can be mounted on or adjacent a cover 116, 284 of the receptacle 92. In the illustrated exemplary embodiment, the control pad 208 is located on a bottom of the dispenser 20, and is retained in position by being mounted to a bottom side of the control support member 240. The control pad 208 can be mounted to the control support member 240 or to another location on the bracket 196 in any manner. As best shown in FIG. 16 for example, the control pad 208 can be mounted to the control support member 230 by fasteners 244 passed through the control pad 208 and the control support member 230. These fasteners 244 can be the same used to mount the circuit board 204 to the control support member 240.

The control pad 208 can have one or more user-manipulatable controls and/or indicators thereon. Alternatively, the control pad 208 can cover or be adapted to receive such controls and/or indicators mounted on another element (such as the circuit board 204 as shown in the figures). For example, the control pad 208 in the illustrated embodiment has two apertures 264, 268 shaped and dimensioned to receive a light emitting diode ("LED") 256 and a switch 260, both of which are connected to the circuit board 204. To this end, the control support member 240 can have one or more apertures 252 or can be otherwise shaped to permit the LED 256 and the switch 260 to be positioned in this manner. In the illustrated embodiment, the control pad 208 has a clear window 264 aligned with one of the apertures 252 and the LED 256 and a resiliently depressible control button 268 aligned with the other aperture 252 and the switch 260. The control button 268 engages the switch 260 when the power button 268 is depressed to close the switch 260 (discussed in greater detail below). In other embodiments, controls and/or indicators on the circuit board 204 need not necessarily be covered with a control pad 208. Other types of controls and control pads can instead be employed, and can be mounted to the control support member 240 or to another part of the bracket 196 in any manner desired.

The circuit board 204 is electrically connected to the pump 200 and can include an electrical power connector 272 (see FIG. 4) operable to engage or connect with the multi-purpose electrical connector 140 of the battery pack 108. In the illustrated embodiment, the power connector 272 is a male-type connector complementary to the exemplary female-type multi-purpose electrical connector 140 described above. Alternatively, the power connector 272 can be any other type of electrical connector connectable with the multi-purpose electrical connector 140. In other embodiments, the power connector 272 is permanently or releasably connected to the battery 112 in other manners, such as by direct connection to the terminals 148 of the battery 112. Operation of the circuit board 204 and user manipulatable controls of the dispenser 20 will be discussed in greater detail below.

In some embodiments, the bracket 196 is also employed to removably attached one or more access panels, doors, or walls to the rest of the dispenser 20 in order to permit access to the battery 112, the pump 200, the circuit board 204, or other internal components of the dispenser 20. For this purpose, the bracket 196 can have one or more flanges or other portions positioned for attachment of one or more access panels, doors, or walls and/or for retaining portions of such elements in a desired position on the dispenser 20.

By way of example only, the bracket 196 in the illustrated embodiment is adapted to retain a pump cover 284 in place on the dispenser 20. As best shown in FIGS. 4, 6 and 16, this exemplary bracket 196 has a cover connecting flange 276 extending from the second portion 216 of the bracket 196, and pair of cover support flanges 280 extending from the first portion 212 of the bracket 196. Although these flanges 276, 280 can extend in any direction suitable for connecting or retaining the pump cover 284, the cover connecting flange 276 extends substantially perpendicularly to the second portion 216 of the bracket 196, while the cover support flanges 280 extend substantially perpendicularly from the first portion 212 of the bracket 196. Like the other parts of the bracket 196 described above, the flanges 276, 280 (if employed) can be integral with the bracket 196 (e.g., bent, stamped, molded, or formed in any other manner with the rest of the bracket 196) or can be connected thereto in any conventional manner.

Figure 17:
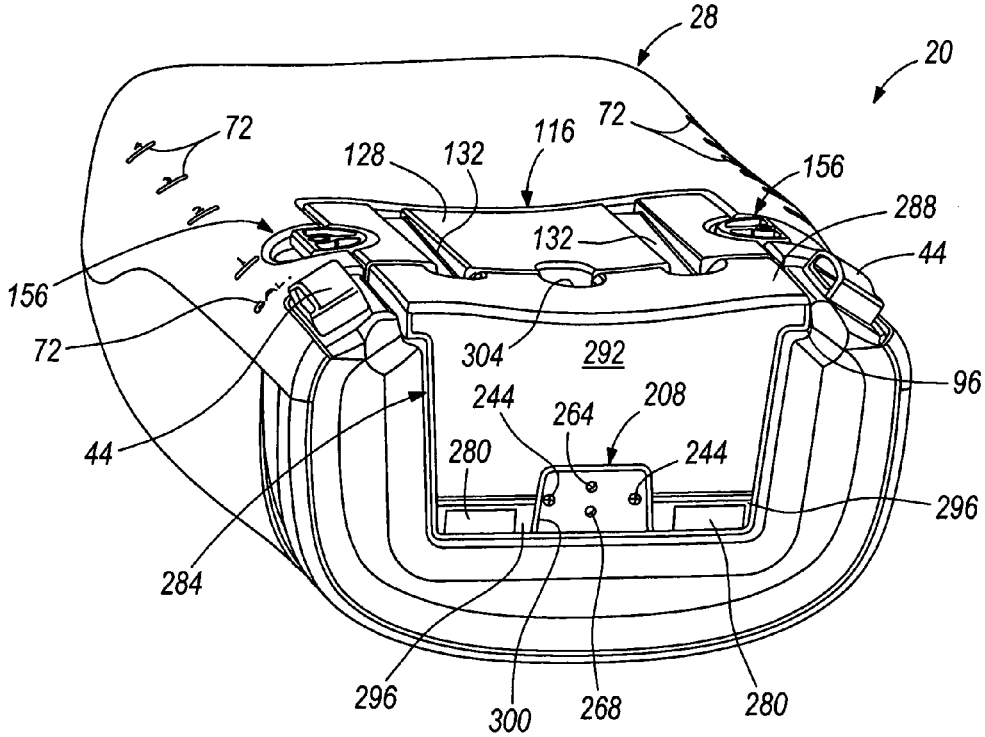
FIG. 17 is a bottom perspective view of the dispenser shown in FIG. 1.

Referring to FIGS. 2, 4 and 17, some embodiments of the dispenser 20 have a pump cover 284 positioned to at least partially enclose the pump 284 and other internal components of the dispenser 20, such as to close or partially close the receptacle 92. Although the pump cover 284 can be connected to or integral with the battery cover 116, the dispenser 20 illustrated in the figures employs two separate covers 116, 284 to close the receptacle 92: one cover 116 to close the part of the receptacle 92 housing the battery pack 108 and one cover 284 to close the remainder of the receptacle 92 housing the pump 200 and other internal components of the dispenser 20.

The pump cover 284 can have any shape, depending at least partially upon the shape of the receptacle 92 (or portion of the receptacle 92) to be covered by the pump cover 284. In the illustrated exemplary embodiment, the pump cover 284 is L-shaped, and has an upstanding wall 288 and a base 292. Like the battery cover 116, the pump cover 284 can be shaped to receive controls (e.g., control pad 208, LED 256, switch 260, etc.) of the dispenser 20. For example, the base 292 of the battery cover 116 in the illustrated embodiment has two protrusions 296 extending from an end thereof and between which the control pad 208 is received.

The pump cover 284 can be connected to the bracket 196 (and therefore, the tank 28) by fastening the upstanding wall 288 to the cover connecting flange 276 using fasteners and by positioning each of the projections 296 above a respective one of the cover support flanges 280. When connected to the tank 28, the pump cover 284 can be received with the lip 96 of the receptacle 92, can cover the pump 200, and can close off the lower portion 104 of the receptacle 92 while still allowing access to the control pad 108 through an access slot 300 defined in the pump cover 284 between the projections 296. In alternative embodiments, the pump cover 284 can be connected to the bracket 196 by fastening at least one of the projections 296 to a respective cover support flange 280 and by trapping the upstanding wall 288 with the cover connecting flange 276. In still other embodiments, both the upstanding wall 288 and at least one of the projections 296 are fastened to the cover connecting flange 276 and one of the cover support flanges 280, respectively.

It should be noted that the pump cover 284 can be connected to the bracket 196 in other manners in which the bracket 196 and/or pump cover 284 are shaped (and in which internal components of the receptacle 92 are arranged) to enable such alternative connecting manners. It should also be noted that the arrangements described above in which a portion of the pump cover 284 is fastened to the bracket 196 while another portion of the pump cover 284 is trapped by the bracket 196 can be performed in still other manners using pump covers 284 and brackets 196 having different shapes than those described above.

In other embodiments, the pump cover 284 can be connected to the bracket 196 in other manners, such as by one or more resilient clips, Velcro straps, clamps, inter-engaging elements, a snap-fit with the bracket 196, or in any other manner permitting removal of the pump cover 284 from the bracket 196 to facilitate access to the lower portion 104 of the receptacle 92 and the components therein.

It should be noted that the pump cover 284 can be fastened to the tank 28 rather than to the bracket 196. For example, the pump cover 284 can be connected to the tank 28 using latches similar to those used to connect the battery cover 116 to the tank 28. Also, the pump cover 284 can be connected to the tank 28 with any type of releasable fastener or fastening method. In summary, the pump cover 284 can be connected to the tank 28 in any manner that allows removal of the pump cover 284 from the tank 28 to facilitate access to the receptacle 92 and components positioned therein.

In those embodiments employing a battery 112 to power the dispenser 20, the power connector 272 can connect the circuit board 204 to the battery 112 entirely within the receptacle 92. However, in other embodiments employing a battery, the power connector 272 can be extended to an external location outside of the receptacle 92 for this purpose. To this end, a power connector aperture 304 can be defined in the pump cover 284 or another wall of the dispenser 20 to enable exit of the power connector 272. In the illustrated embodiment, a power connector aperture 304 is located in the upstanding wall 288 of the pump cover 284 to allow the power connector 272 to extend from the interior of the receptacle 92 to the exterior of the pump cover 284. When the power connector 272 is positioned externally of the pump cover 284, it is releasably connectable with the multi-purpose electrical connector 140 (discussed in greater detail below).

Referring to FIGS. 4 and 16, the pump 200 in the illustrated exemplary embodiment is a diaphragm pump. Alternatively, any other type of pump can instead be utilized with the dispenser 20, including without limitation centrifugal, piston, gear, and other types of pumps. Operation of pumps, and specifically diaphragm pumps, is well known to those having ordinary skill in the art and, therefore, only components and operation of the pump 200 necessary to describe features and operation of the dispenser 20 is described herein.

Figure 18:
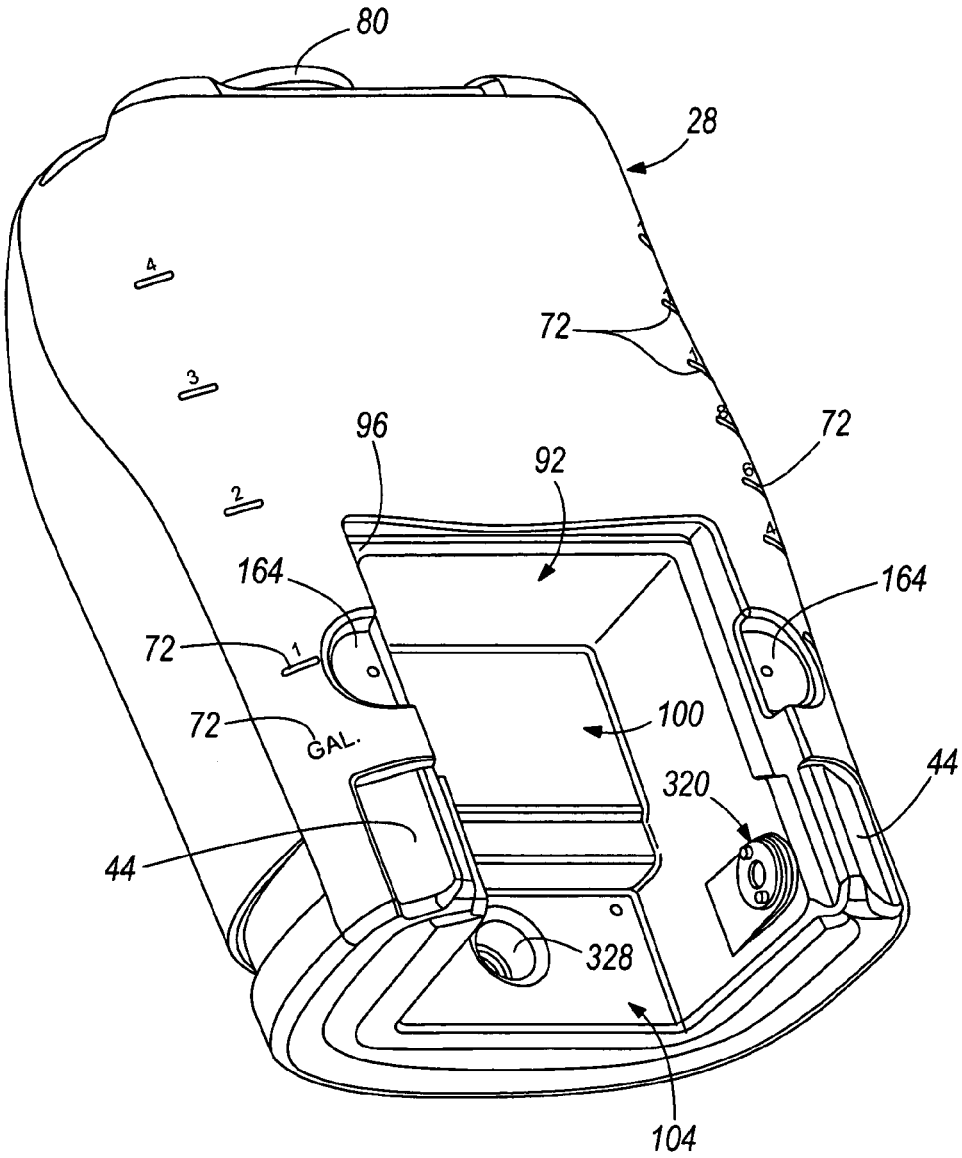
FIG. 18 is a front perspective view of the dispenser shown in FIG. 1, showing a fitting on the tank of the dispenser.

The pump 200 is drivably connected to an electric motor 308 in a conventional manner, and includes a fluid inlet 312 and a fluid outlet 316. A spin-welded fitting 320 (see FIG. 18) is positioned within the receptacle 92 and provides a connection on the tank 28 through which fluid can be extracted from the tank 28 by the pump 200. The use of a fluid connector 320 that has been spin-welded on the tank 28 presents manufacturing advantages related to the cost and reliability of establishing such a connection to tanks comprising certain materials (e.g., plastic) and manufactured in certain manners (e.g., blow-molding). An inlet tube (not shown) or other conduit is connected between the fitting 320 and the inlet 312 of the pump 200 to fluidly connect the interior of the tank 28 and the pump 200, while an outlet tube (not shown) or other conduit is connected between the outlet 316 of the pump 200 and a dispensing tube 324 (see FIG. 1) or other conduit to fluidly connect the pump 200 and the dispensing tube 324. When activated, the pump 200 pumps fluid from the cavity 64, through the fitting 320, through the inlet tube, into the pump 200 through the inlet 312, out of the pump 200 through the outlet 316, through the outlet tube and into the dispensing tube 324. In some embodiments, the inlet tube and the outlet tube are defined by the same tube.

The path of fluid through the dispenser 20 as described above is only one of several manners in which fluid can be moved from the tank 28 to the dispensing tube 324. Accordingly, fluid can be pumped from the cavity 64 to the dispensing tube 324 along other paths, through other components and in other manners. For example, other types of fittings, ports, or openings can be connected to or defined by the tank 28 for connection to conduit or other devices used to move fluid from the tank 28. Also, other manners in which to fluidly connect the tank 28 to the pump 200 and the pump 200 to the dispensing tube 324 can be used, such as, for example, rigid piping and a direct connection between the inlet 312 of the pump 200 to the tank 28 and/or the outlet 316 of the pump 200 to the dispensing tube 324.

Fluid can exit the pump 200 and can pass into the dispensing tube 324 at any position and orientation on the dispenser 20. For example, the pump 200 can be directly or indirectly connected to a dispensing tube 324 extending in a forward, rearward, or lateral direction from the dispenser 20, or from a bottom or top of the dispenser 20 as desired. In this regard, the dispensing tube 324 can be located on any surface of the dispenser 20 and can be oriented in any direction on such surface (e.g., located on the rear of the dispenser and oriented in a downward or lateral direction, located on a side of the dispenser and oriented in a forward or lateral direction, and the like).

In some embodiments, the dispensing tube 324 extends through at least a portion of the tank 28 prior to reaching a point on the dispenser 20 from which the dispensing tube 324 extends from the dispenser 20. In particular, the dispensing tube 324 can extend through walls of the dispenser 28 (i.e., into and out of the cavity 64) or can extend through a portion of the tank 28 fluidly isolated from the cavity 64. If extending through walls of the dispenser 28, the dispensing tube 324 and/or tank walls can be provided with fluid-tight fittings (e.g., with seals, gaskets, grommets, and the like) preventing leakage of fluid from the tank 28) as appropriate.

In those embodiments in which the dispensing tube 324 extends through a portion of the tank 28 fluidly isolated from the cavity 64 (an example of which is described in greater detail below), such a fluid-tight fitting is not necessarily required. In such embodiments, the tank 28 can be shaped to define an aperture through which the dispensing tube 324 extends. For example, the aperture can be a conduit 328 extending vertically, horizontally, or both vertically and horizontally through a part of the cavity 64, an external groove or recess defined in any wall of the tank 28 (e.g., at the bottom, side, and/or top of the tank 28), and the like. In each case, the tank 28 is shaped to enable the dispensing tube 324 to pass thereby or therethrough in any desired direction and orientation, receives a part of the dispensing tube 324, and is open or closed about that part of the dispensing tube 324. An example of a tank 28 shaped to receive a dispensing tube 324 therethrough is illustrated in the figures.

Referring in particular to FIGS. 1 and 5–6, a tube conduit 328 is defined through the tank 28 from a rear surface of the lower portion 104 of the receptacle 92 to a rear surface of the tank 28. The conduit 328 in the illustrated embodiment is formed by the blow-molding process of the tank 28, although the conduit 328 can be formed in any other manner depending at least partially (in some cases) upon the manner in which the tank 28 is formed. The conduit 328 in this embodiment extends through the cavity 64, but is not in fluid communication therewith. The conduit 328 provides the dispensing tube 324 with access to the outlet 316 of the pump 200 from a rear of the tank 28, and facilitates fluid connection between the dispensing tube 324 and the outlet 316. In the illustrated exemplary embodiment, the conduit 328 is substantially circular in shape. Alternatively, the conduit 328 can take any other shape permitting the dispensing tube 324 to extend through the conduit 328 to the outlet 316 of the pump 200. In some cases, the bracket 196 can be shaped or can have an aperture permitting the dispensing tube 324 to pass from the receptacle 92. By way of example only, a conduit aperture 332 is defined in the bracket 196 in the illustrated embodiment, and is in alignment with the conduit 328 to provide the dispensing tube 324 with access therethrough to the outlet 316 of the pump 200. In the illustrated exemplary embodiment, the conduit aperture 332 of the bracket 196 is substantially circular in shape. Alternatively, the conduit aperture 332 can take any other shape through which the dispensing tube 324 can pass.

By having the conduit 328 extend through a rear surface of the tank 28 and the dispensing tube 324 extend out of the conduit 328 to location behind (to the rear of) the tank 28, the dispensing tube 324 is positioned in a convenient and comfortable position for the user. The dispensing tube 324 can instead extend from the front of the tank 28 (e.g., through either cover 116, 284 or through a front wall of the tank 28), in which case provision for proper clearance between the dispenser 20 and the user to permit the dispensing tube 324 to pass therebetween can be made as needed. Alternatively, the dispensing tube 324 can exit from the front of the tank 28 at a location disposed laterally from the center of the tank 28.

In some alternative embodiments, the dispensing tube 324 extends out of a bottom of the tank 28. In such cases, the dispenser 20 can have a separate frame, housing, or support depending downward from the tank 28 to enable to tank to be placed upon a support surface without compressing the dispensing tube 324 between the tank 28 and the support surface.

As mentioned above, the dispensing tube 324 can extend away from the dispenser 20 at any location on the dispenser 20. In some embodiments (including those embodiments in which the dispensing tube 324 extends through the tank 28 in any manner as described above), the dispensing tube 324 is located in the front, rear, bottom, or top walls of the tank 28 and is centrally located between lateral walls of the tank 28, thereby enabling a user to extend the dispensing tube 324 to his or her left or right as desired. For example, the conduit 328 and dispensing tube 324 in the illustrated embodiment is substantially centrally located to accommodate both right handed and left handed users. The dispensing tube 324 can be pulled around to the front of the dispenser 20 from either side and still provide a substantially equal length of dispensing tube 324.

If desired, the tank 28 can be provided with one or more tube guide recesses 336, such as those in the rear surface of the tank 28 illustrated in the figures. Such recesses 336 can at least partially receive the dispensing tube 324 to assist in guiding the dispensing tube 324 around either side of the tank 28.

In still other alternative embodiments employing an open or closed conduit 328 (i.e., closed about the dispensing tube 324 or open on one or more sides), the conduit 328 can extend to either lateral side of the tank 28 to position the dispensing tube 324 for a right-handed or left-handed user. More particularly, the conduit 328 can extend to the right side of the tank 28 to position the dispensing tube 324 for a right-handed user or the conduit 328 can extend to the left side of the tank 28 to position the dispensing tube 324 for a left-handed user.

Although the illustrated exemplary embodiment has only one conduit 328 as described above, it will be appreciated that two or more conduits 328 can be defined through the tank 28 as desired. For example, conduits 328 can be defined through both the right and left sides of the tank 28 to provide the user with the option of extending the dispensing tube 324 out of either side of the tank 28. Any number of conduits 328 can be defined in the tank 28 at any location in the tank 28.

The description of the illustrated embodiment above relates primarily to the fluid communication between the conduit 328 and the dispensing tube 324. It should be noted that an outlet tube (not shown) can be fluidly connected to the outlet of the pump 200 and can extend and be fluidly connected the conduit 328 in any conventional manner (such as by any conventional fluid fitting on the tank 28 at an inlet end of the conduit 328). Similarly, the dispensing tube 324 can be fluidly connected to an outlet end of the conduit 328. In both such cases, the fluid conduit 328 can be exposed to fluid passing therethrough rather than only receiving a fluid tube (such as dispensing tube 324 and/or a pump outlet tube) therethrough. In this regard, the dispensing tube 324 can be connected directly to the pump 200, to an outlet tube connected to the pump 200, or to the fluid conduit 328.

Some embodiments of the present invention have two modes of operation: a spraying or dispensing mode in which the dispenser 20 is operable to dispense fluid, and a charging mode in which the battery 112 is chargeable. In order to place the dispenser 20 in the dispensing mode, the pump 200 is electrically connected to the battery 112 by connecting the power connector 272 of the circuit board 204 to the multi-purpose electrical connector 140 of the battery pack 108. Once the connectors 140, 272 are connected, the battery 112 is electrically connected to the pump 200 and the dispenser 20 is in the dispensing mode. In order to place the dispenser 20 in the charging mode, the pump 200 is electrically disconnected from the battery 112 by disconnecting the power connector 272 of the circuit board 204 from the multi-purpose electrical connector 140 of the battery pack 108 and connecting an electrical connector of a battery charger (not shown) to the multi-purpose electrical connector 140. Once these connectors are connected, the battery 112 is capable of being charged and the dispenser is in the charging mode.

Although the dispensing and charging modes of the dispenser 20 in the illustrated exemplary embodiment are mutually exclusive (i.e., the dispenser 20 cannot be in both modes at the same time), other embodiments enable the battery 112 to be charged while power is supplied to operate the dispenser 20. In such embodiments, the battery 112 can be provided with two electrical connectors: one for releasable connection to a battery charger and another for permanent or releasable connection to the circuit board 204. In still other embodiments, such a connection arrangement can be employed even if the dispenser 20 cannot be operated while the battery 112 is charging.

Figure 20:
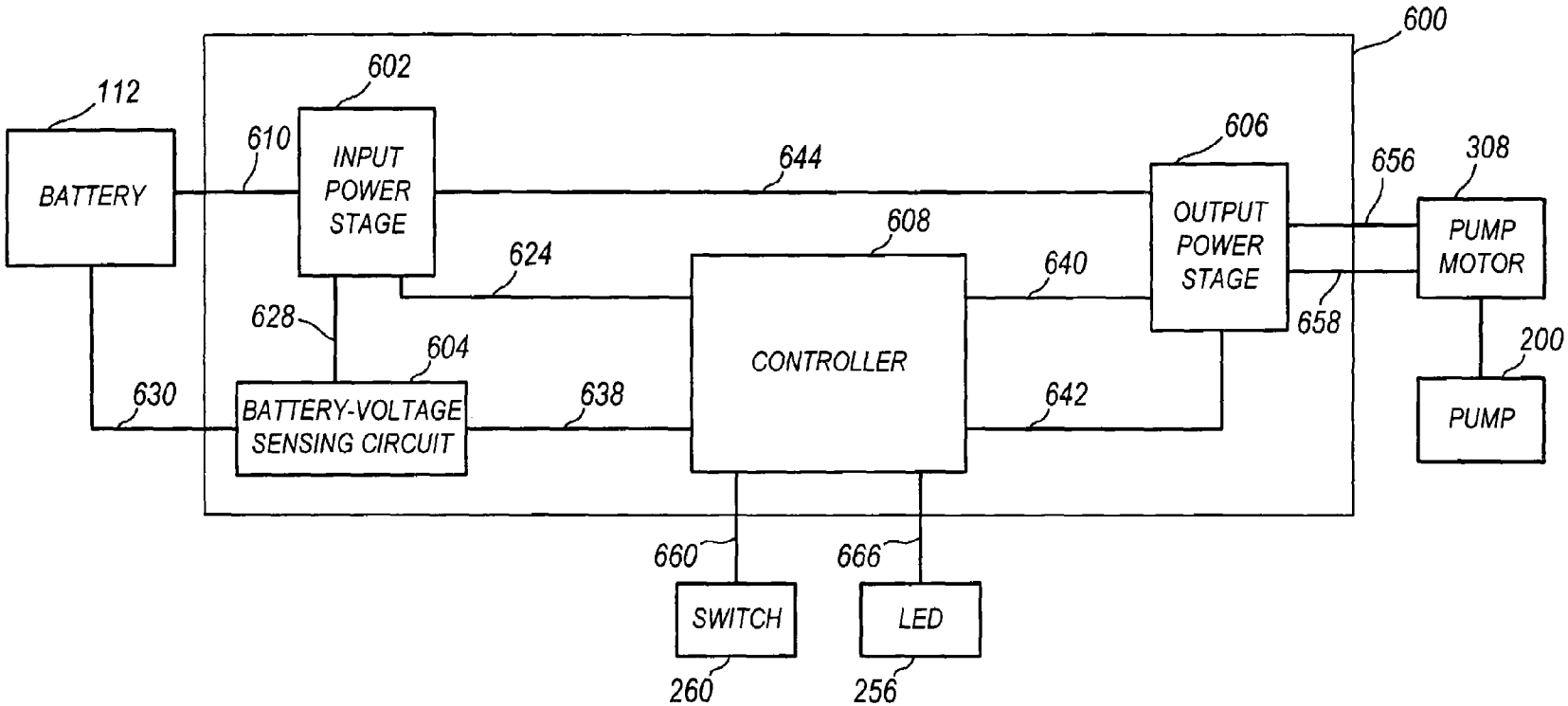
FIG. 20 is a schematic illustration of an embodiment of a dispenser control circuit for use with the dispenser shown in FIG. 1.

FIG. 20 includes a schematic illustration of an exemplary embodiment of a dispenser control circuit 600 for use with a dispenser 20 according to the present invention. The dispenser control circuit 600 can be mounted on the circuit board 204 and supported by the support bracket 196 (shown in FIG. 16), although the dispenser control circuit 600 can be located in other suitable areas of the dispenser 20 as desired. By way of example only, the dispenser control circuit 600 can also or instead be mounted inside or adjacent the battery 112. As shown in FIG. 20, the dispenser control circuit 600 can be connected to the battery 112, the switch 260, the LED 256, and the pump motor 308. In some embodiments, the dispenser control circuit 600 includes an input power stage 602, a battery-voltage sensing circuit 604, an output power stage 606, and a controller 608.

Figure 21:
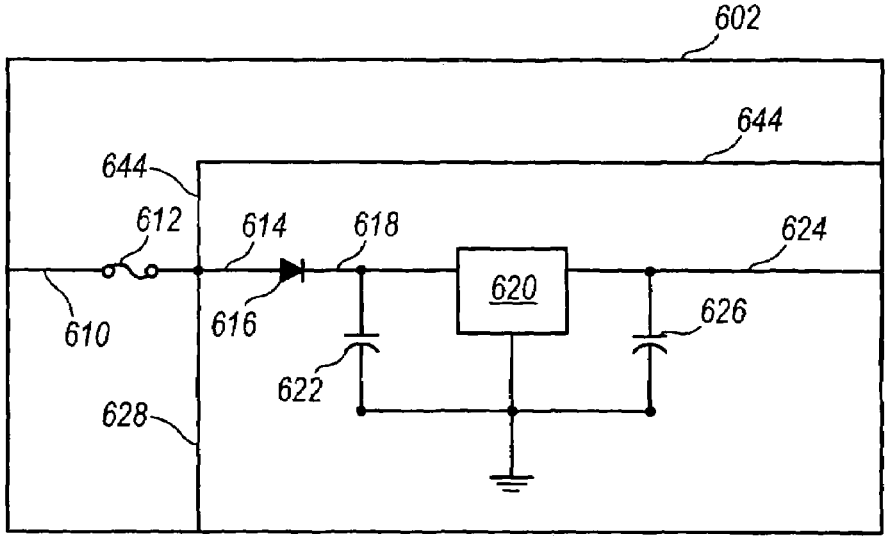
FIG. 21 is a schematic illustration of an embodiment of an input power stage of the dispenser control circuit shown in FIG. 20.

As shown in FIGS. 20 and 21, the input power stage 602 can be connected to the positive terminal of the battery 112 by a connection 610. As shown in FIG. 21, the connection 610 can be connected to a fuse 612 (e.g., a resettable polyfuse having a capacity of 16 volts and 3 amps and a 5.2 amp trip current like Model No. RGE300 manufactured by Raychem Corp.). The fuse 612 can be connected to a diode 616 (e.g., a rectifier diode like Model No. 1N4044-T) by a connection 614. The input power stage 602 can also include a voltage-regulator integrated circuit 620 (e.g., Model No. LM78L05ACZ-TO92 package manufactured by National Semiconductor) connected to the diode 616 by a connection 618. A first capacitor 622 (e.g., an axial, ceramic capacitor having a capacitance of 0.33 $\mu$F and a working-voltage rating of 50 volts like Model No. C412C334M5U5CA7200 manufactured by KEMET Corp.) can be connected between the connection 618 and ground. A second capacitor 626 (e.g., an axial, ceramic capacitor having a capacitance of 0.1 $\mu$F and a working-voltage rating of 50 volts like Model No. C412C104K1R5CA7200 manufactured by KEMET Corp.) can be connected between a connection 624 and ground. The voltage regulator integrated circuit 620 and the capacitors 622 and 626 can provide a voltage source that coverts voltage from the battery 112 into a suitable voltage ($V_{cc}$) that is provided to the controller 608 via the connection 624.

Figure 22:
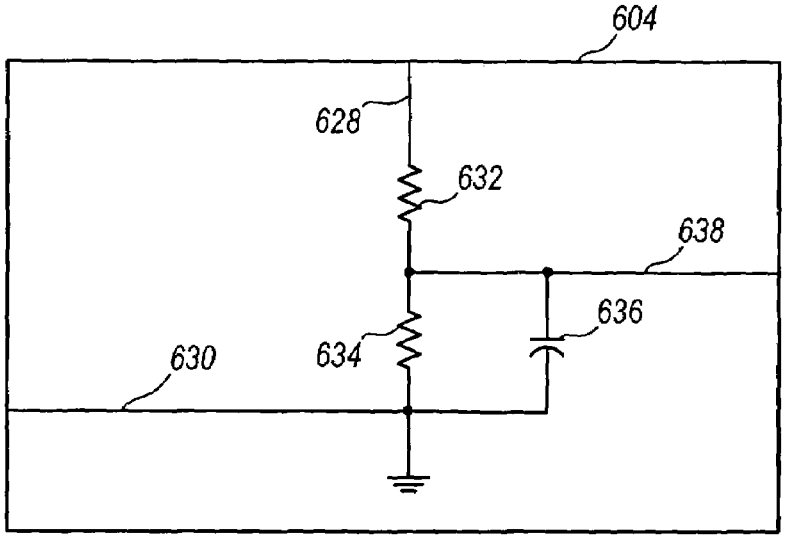
FIG. 22 is a schematic illustration of an embodiment of a battery-voltage sensing circuit of the dispenser control circuit shown in FIG. 20.

As shown in FIGS. 20 and 22, the battery-voltage sensing circuit 604 can also be connected to the input power stage 602 via a connection 628 between the fuse 612 and the diode 616 (see FIG. 21). The battery-voltage sensing circuit 604 can be connected to the negative terminal of the battery 112 by a connection 630. As shown in FIG. 22, the battery-voltage sensing circuit 604 can include a first resistor 632 (e.g., 1.2 MΩ, Model No. CFR-25JB-1M5 manufactured by Yageo Corp.) connected in series to a second resistor 634 (e.g., 680 kΩ, Model No. CFR-25JB-680K manufactured by Yageo Corp.). The second resistor 634 can be connected in parallel with a capacitor 636 (e.g., an axial, ceramic capacitor having a capacitance of 0.1 $\mu$F and a working-voltage rating of 50 volts like Model No. C410C103K5R5CA7200 manufactured by KEMET Corp.). A connection 638 between the first and second resistors 632 and 634 can provide a signal representing the voltage of the battery 112 to the controller 608.

Figure 23:
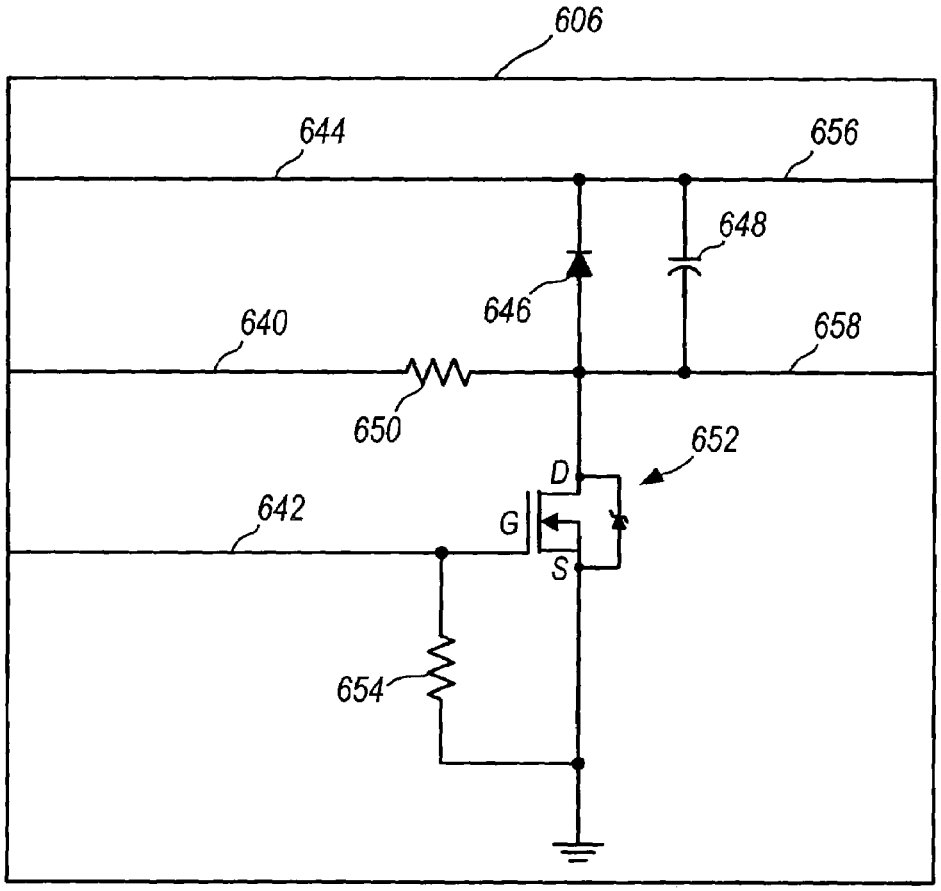
FIG. 23 is a schematic illustration of an embodiment of an output power stage of the dispenser control circuit shown in FIG. 20.

As shown in FIGS. 20 and 23, the output power stage 606 can be connected to the controller 608 by a first connection 640 and a second connection 642. The output power stage 606 can also be connected to the input power stage 602 by a third connection 644. As shown in FIG. 23, an exemplary output power stage 606 includes a diode 646 (e.g., a rectifier diode like Model No. 1N4044-T) connected between the first connection 640 and the third connection 644. A capacitor 648 (e.g., an axial, ceramic capacitor having a capacitance of 0.0047 $\mu$F and a working-voltage rating of 100 volts like Model No. C410C472K1R5CA7200 manufactured by KEMET Corp.) can be connected in parallel with the diode 646. The first connection 640 can include a first resistor 650 (e.g., 270 kΩ, Model No. CFR-25JB-270K manufactured by Yageo Corp.). The second connection 642 can be connected to the gate of a transistor 652 (e.g., a single-gate, n-channel MOSFET like Model No. IRL520N manufactured by International Rectifier). As described in more detail below, the transistor 652 can act as a switch in order to selectively provide power to the pump motor 308 when the controller 608 provides an appropriate signal to the gate via connection 642. A second resistor 654 (e.g., 10 kΩ, Model No. CFR-25JB-10K manufactured by YAG) can be connected between the connection 642 and ground. When the transistor 652 is ON (as described in more detail below), positive power from the input power stage 602 is provided to the pump motor 308 via the connection 644 and a connection 656 and negative power is provided to the pump motor 308 via a connection 658.

In some embodiments, the dispenser 20 can include a mechanical or electronic pressure switch or sensor (not shown). A pressure switch or sensor can be mounted on or adjacent to the pump 200 (e.g., in an output chamber of the pump 200 or mounted on the housing of the pump 200) or within a hose or port connected to the pump 200 (e.g., in-line with an output hose of the dispenser 20). A pressure switch or sensor can also be located in-line with any suitable one of the connections described with respect to the dispenser control circuit 600. In one embodiment, a pressure switch or sensor is located on the pump 200 and the controller 608 can electronically sense the signal provided by the pressure switch or sensor via the connections 656 and/or 658 between the output power stage 606 and the pump motor 308.

Figure 24:
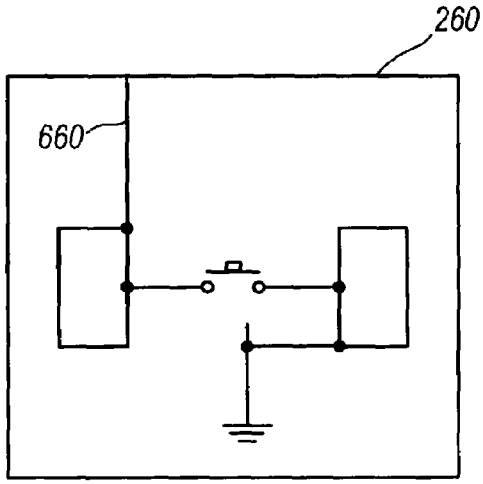
FIG. 24 is a schematic illustration of an embodiment of a switch of the dispenser shown in FIG. 1 and the dispenser control circuit shown in FIG. 20.
Figure 25:
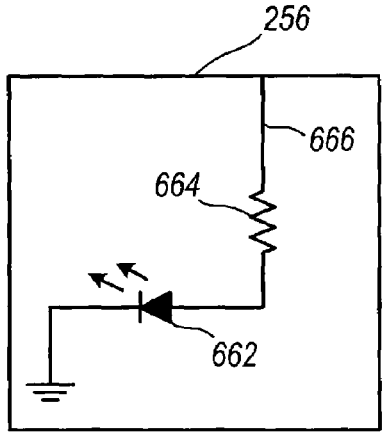
FIG. 25 is a schematic illustration of an embodiment of a LED of the dispenser shown in FIG. 1 and the dispenser control circuit shown in FIG. 20.

As shown in FIG. 24, the switch 260 can include a momentary pushbutton, tactile switch (e.g., Model No. GSE10.00F130QP manufactured by E-Switch). As also shown in FIGS. 20 and 24, the switch 260 can be connected to the controller 608 by a connection 660. As shown in FIG. 24, the LED 256 can include a diode 662 (e.g., a red, T-1 size diode like Model No. LTL-4266N manufactured by Lite-On Technology Corp.) connected in series with a resistor 664 (e.g., 1 kΩ, Model No. CFR-25JB-1K0 manufactured by Yageo Corp.). The resistor 664 can be connected to the controller 608 by a connection 666.

Figure 26:
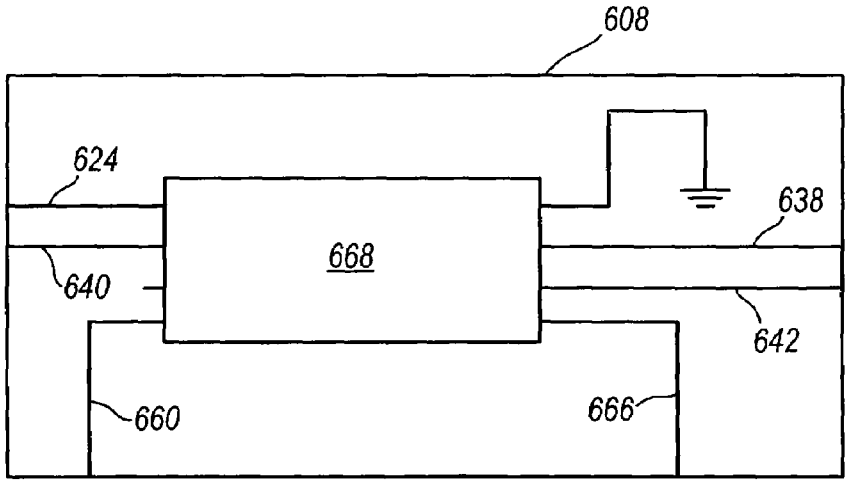
FIG. 26 is a schematic illustration of an embodiment of a controller of the dispenser control circuit shown in FIG. 20.

As shown in FIG. 26, the controller 608 can include a microcontroller 668 (e.g., a microprocessor like Model No. PIC12C671-04/P manufactured by Microchip Technology), which receives various signals and can be programmed to perform various functions as described in more detail below. As used herein and in the appended claims, the term "microcontroller" is not limited to just those integrated circuits referred to in the art as microcontrollers, but broadly refers to one or more microcomputers, processors, application-specific integrated circuits, or any other suitable programmable circuit or combination of circuits. As noted above and as shown in FIGS. 20 and 26, the microcontroller 668 receives a suitable voltage ($V_{cc}$) from the input power stage 602 via the connection 624. The microcontroller 668 can also receive signals from the output power stage 606 via the connection 640, from the switch 260 via the connection 660, and from the LED 256 via the connection 666. The microcontroller 668 can receive a signal representing the voltage level of the battery from the battery-voltage sensing circuit 604 via the connection 638. In response to one or more of these signals, the microcontroller 668 can generate and provide a control signal to the output power stage 606 via the connection 642. In some embodiments, the control signal is pulse-width modulated (PWM).

In some embodiments, if the battery 112 drains below a low threshold (e.g., 10.5 volts for a 12-volt battery), the microcontroller 668 can provide a "low" control signal to the output power stage 606 so that the transistor 652 turns OFF and power is not provided to the pump motor 308. Once the battery voltage drops below the low threshold, the microcontroller 668 can be programmed to provide a "low" control signal until the battery 112 is recharged. In this manner, the pump motor 308 only operates when the battery voltage is above the low threshold or the battery 112 has been recharged.

Each of the electrical components, model numbers and values for the dispenser control system 600 are provided by way of example only and do not limit the scope of the appended claims. Also, the dispenser control system 600 can include more or less electrical components than those described herein. In addition, one or more electrical components can be combined in order to perform each of the functions described below with respect to the flowchart of FIG. 19.

Figure 19:
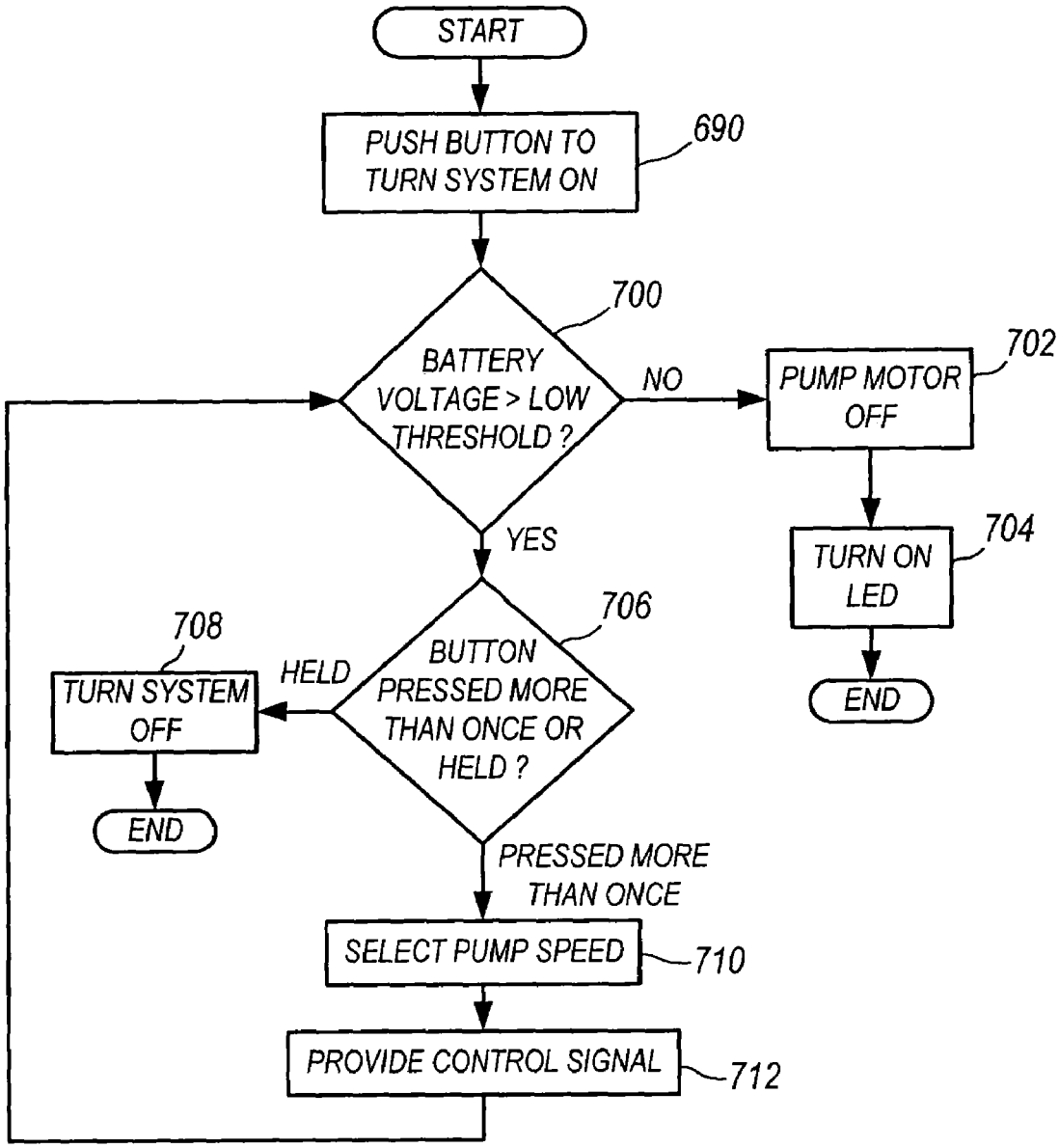
FIG. 19 is a flowchart illustrating an exemplary method of controls operation of the dispenser shown in FIG. 1.

Referring to FIG. 19, the microcontroller 668 can be programmed to operate the dispenser control system 600 as follows. A user can push (at 690) the button of the switch 260 in order to turn the dispenser control system 600 ON. The microcontroller 668 can determine (at 700) whether the voltage level of the battery 112 is greater than a low threshold (e.g., 10.5 volts for a 12-volt battery). The microcontroller 668 can read the signal from the battery-voltage sensing circuit 604 as provided by the connection 638. If the voltage level of the battery 112 is less than the low threshold, the microcontroller 668 can provide a "low" control signal on connection 642 so that the transistor 652 and the pump motor 308 will remain OFF (at 702). The microcontroller 668 can also provide a signal on connection 666 in order to turn the LED 256 ON (at 704) to indicate that the battery must be recharged.

If the voltage level of the battery 112 is greater than the low threshold, the microcontroller 668 can determine (at 706) whether the user pressed the button of the switch 260 more than once within a first predetermined time period (e.g., 10 seconds) or whether the user pressed and held the button of the switch 260 for a second predetermined time period (e.g., 5 seconds). If the user held the button of the switch 260 for longer than the second predetermined time period, the microcontroller 668 can turn the dispenser control system 600 OFF (at 708).

If the user pressed the button of the switch 260 more than once within the first predetermined time period, the microcontroller 668 can select (at 710) the pump speed corresponding to the number of times the user pressed the button. Some embodiments of the dispenser 20 include four pump speed settings (e.g., 4-volt, 6-volt, 8-volt and 10-volt pump speed settings). For example, the user can press the button once for the slowest pump speed setting and four times for the fastest pump speed setting. The microcontroller 668 can provide (at 712) the appropriate control signal for the selected pump speed setting to the output power stage 606 via the connection 642. In some embodiments, the microcontroller 668 can provide a pulse-width modulated control signal having a different duty cycle for each of the pump speed settings.

Once the pump motor 308 is operating at a particular pump speed setting, the microcontroller 668 returns to block 700 in order to determine whether the voltage of the battery 112 has been drained to less than the low threshold. If the voltage is not less than the low threshold, the microcontroller 668 continues to block 706 to determine if the user has pressed the button of the switch 260 again or if the user has now pressed and held the button of the switch 260. If the user has pressed the button of the switch 260 one or more times, the microcontroller 668 determines (at 710) a new pump speed setting corresponding to the total number of times the user has pressed the button since the system 600 was operating. For example, the user can begin with the second pump speed setting by pressing the button twice and then increase the speed of the pump motor 308 from the second pump speed setting to the fourth pump speed setting by pressing the button twice more. The microcontroller 668 can also cycle back to a lower pump speed setting or through all the pump speed settings if the user continues to press the button of the switch 260. The microcontroller 668 can provide (at 712) the appropriate control signal for the selected pump speed setting. The microcontroller 668 can repeat the process shown in FIG. 19 until the battery voltage falls below the low threshold or the user presses and holds the button of the switch 260 in order to turn the system 600 OFF. Although the control and operation of the dispenser 20 has been described with respect to the flowchart having the particular order shown in FIG. 19, alternate methods of controlling and operating the dispenser 20 having different steps or steps that occur in a different order can be utilized while still falling within the spirit and scope of the present invention.

In some embodiments, the controller 608 can read a signal from a pressure sensor or switch in order to control the pump motor 308. The dispenser 20 can include an output hose and wand (not shown) coupled to the pump 200. The pressure sensor or switch can be used to determine or measure the pressure in the output hose and wand. The output wand can also include a handle with a trigger (not shown). In order to initially begin dispensing fluid, a user can press the button of the switch 260, grasp the handle, and pull the trigger. As fluid is dispensed, fluid flows out of the output hose and wand, resulting in the fluid pressure in the system being relatively low. When the user releases the trigger, fluid stops flowing out of the output hose and wand. The fluid pressure in the system then builds up until the output hose and wand are filled with fluid and the fluid pressure is relatively high. When the fluid pressure reaches a predetermined threshold pressure, the controller 608 can read the pressure switch or sensor and respond by shutting down the pump motor 308.

In one embodiment, the controller 608 can read a pressure sensor or switch in order to operate the dispenser control circuit 600 in more than one mode. For example, the dispenser control circuit 600 can operate in a light sleep mode and a deep sleep mode. The controller 608 can place the dispenser control circuit 600 into a light sleep mode in order to conserve power after the controller 608 shuts down the pump motor 308 (as discussed above). The controller 608 can also place the dispenser control circuit 600 into a deep sleep mode in order to conserve more power if the pump motor 308 has been shut down for a predetermined time period (e.g., 10 minutes). In order to wake the dispenser control circuit 600 from the light sleep mode and to begin dispensing fluid again, a user can grasp the handle and pull the trigger. The pressure switch or sensor can sense that the pressure is dropping as fluid begins to flow out of the output hose and wand. In order to wake the dispenser control circuit 600 from the deep sleep mode and to begin dispensing fluid again, a user can be required to push the button of the switch 260 and then grasp the handle and pull the trigger. It should also be understood that only one sleep mode could be used in some embodiments, and that in other embodiments, the controller 608 can control the pump motor 308 without the use of sleep modes.

In order to switch the dispenser 20 in the illustrated exemplary embodiment from the dispensing mode to the recharging mode, the power connector 272 is disconnected from the multi-purpose electrical connector 140 and a charger (not shown) is connected to the multi-purpose electrical connector 140 with a complementary electrical charging connector (not shown). Since the multi-purpose electrical connector 140 is electrically connected to the battery 112, the charger is electrically connected to the battery 112 by connecting the electrical charging connector to the multi-purpose electrical connector 140. As is apparent from the drawings and the present description both above and to follow, no components of the illustrated dispenser 20 (e.g., the battery 112, the battery support 116, electrical connectors, electrical terminals 148, etc.), have to be removed in order to switch the dispenser 20 from dispensing mode to recharging mode. The power connector 272 need only be disconnected from the multi-purpose electrical connector 140 in order to charge the battery 112.

In other embodiments of the present invention, the battery pack 108 is removed from the receptacle 92 for charging purposes. In some of these embodiments, the electrical connector 140 is removable from the receptacle 92 with the battery 112 and the battery support 116 while maintaining electrical connection with the battery 112, and therefore, the battery 112 can be charged when the battery pack 108 is removed from the receptacle 92. With reference to the illustrated embodiment, the battery pack 108 can be disconnected from the tank 28 simply by rotating the latches 156 from their locked positions to their unlocked positions and by removing the battery pack 108 from the receptacle 92.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

We claim:

1. A portable backpack fluid dispenser operable to dispense fluid, the dispenser comprising:

a tank defining a cavity in which fluid is supportable;

a pump fluidly connected to the tank and having an inlet and an outlet, wherein fluid is pumpable from the cavity into the pump through the inlet and is pumpable out of the pump through the outlet;

a dispensing tube in fluid connection with the outlet of the pump and being operable to pass fluid therethrough; and a conduit defined in the tank and at least partially passing through the cavity, the dispensing tube being at least partially positioned in the conduit.

2. The dispenser of claim 1, wherein the conduit extends through the tank from a front surface of the tank to a rear surface of the tank.

3. The dispenser of claim 2, wherein the dispensing tube is at least partially received in the conduit and extends out of the conduit from the rear surface of the tank.

4. The dispenser of claim 1, wherein the conduit has a substantially round cross-sectional shape.

5. The dispenser of claim 1,wherein the conduit is shaped to complement the shape of the dispensing tube.

6. The dispenser of claim 1, wherein the conduit extends through a wall of the tank.

7. A method of dispensing fluid from a portable backpack fluid dispenser, the method comprising:

providing a tank defining a cavity operable to support fluid therein, the tank having a conduit passing at least partially through the cavity;

fluidly connecting a pump to the tank, the pump having an inlet and an outlet;

providing a dispensing tube at least partially received within the conduit, the dispensing tube having an end fluidly connected to the outlet of the pump;

pumping fluid from the tank into the pump through the inlet of the pump; and pumping fluid out of the pump and into the dispensing tube through the outlet of the pump.

8. The method of claim 7, further comprising pumping fluid from the tank through the conduit.

9. The method of claim 7, further comprising pumping fluid from the tank through the conduit from a front surface of the tank to a rear surface of the tank.

10. The method of claim 7, wherein the conduit has a cross-sectional shape complementary to a cross-sectional shape of the dispensing tube.

11. A portable backpack fluid dispenser operable to dispense fluid, the dispenser comprising:

a tank operable to support fluid therein;

a bracket connected to the tank;

a pump connected to the bracket and including an inlet and an outlet, the pump being operable to pump fluid from the cavity into the inlet and pump fluid out of the pump through the outlet; and a cover selectively connectable to the bracket and being operable to substantially cover the pump when connected to the bracket.

12. The dispenser of claim 11, further comprising:

a receptacle in the tank; and a bracket coupled to the tank within the receptacle.

13. The dispenser of claim 12, wherein the cover is at least partially covers the receptacle when the cover is connected to the bracket.

14. The dispenser of claim 11, wherein the bracket includes a first portion mounted to the tank and a second portion extending at an angle with respect to the first portion.

15. The dispenser of claim 14, wherein the pump is mounted to the second portion of the bracket.

16. The dispenser of claim 11, further comprising a conduit extending through the tank from a position adjacent the bracket.

17. A portable backpack fluid dispenser operable to dispense fluid, the dispenser comprising:

a tank operable to support fluid therein;

a bracket connected to the tank;

a pump connected to the bracket and including an inlet and an outlet, the pump being operable to pump fluid from the cavity into the inlet and pump fluid out of the pump through the outlet; and a cover selectively connectable to the bracket and being operable to substantially cover the pump when connected to the bracket, wherein the bracket includes a first portion mounted to the tank and a second portion extending at an angle with respect to the first portion wherein the second portion of the bracket includes a flange extending therefrom; and the pump is mounted to the flange.

18. The dispenser of claim 17, wherein:

the flange is integral with the second portion of the bracket; and the flange is bent out of a plane in which the first portion of the bracket lies.

19. A method of assembling a portable backpack fluid dispenser operable to dispense fluid, the method comprising:

providing a tank operable to support fluid therein;

connecting a bracket to the tank;

connecting a pump to, the pump being supportable by the bracket and being operable to pump fluid from the tank; and connecting a cover to the bracket, the cover being operable to substantially cover the pump when connected to the bracket.

20. The method of claim 19, further comprising connecting a bracket to the tank within a receptacle defined within the tank.

21. The method of claim 20, further comprising at least partially covering the receptacle with the cover.

22. The method of claim 19, further comprising forming the first and second portions of the bracket from a single piece of sheet material.

23. The method of claim 19, further comprising mounting a control circuit to a flange of the bracket.

24. A portable backpack fluid dispenser operable to dispense fluid, the dispenser comprising:

a tank defining a cavity in which fluid is supportable;

a pump fluidly connected to the tank and having an inlet and an outlet, wherein fluid is pumpable from the cavity into the pump through the inlet and is pumpable out of the pump through the outlet;

a dispensing tube in fluid connection with the outlet of the pump and being operable to pass fluid therethrough; and a conduit defined in the tank and at least partially passing through the cavity, the dispensing tube being at least partially positioned in the conduit, wherein the dispensing tube extends from the pump, through the conduit, and away from the tank.

25. A portable backpack fluid dispenser operable to dispense fluid, the dispenser comprising:

a tank defining a cavity in which fluid is supportable;

a pump fluidly connected to the tank and having an inlet and an outlet, wherein fluid is pumpable from the cavity into the pump through the inlet and is pumpable out of the pump through the outlet;

a dispensing tube in fluid connection with the outlet of the pump and being operable to pass fluid therethrough; and a conduit defined in the tank and at least partially passing through the cavity, the dispensing tube being at least partially positioned in the conduit, wherein the tank defines a receptacle in at least one wall of the tank; and the conduit extends from the receptacle to allow the dispensing tube to pass through the tank from the receptacle.

26. A portable backpack fluid dispenser operable to dispense fluid, the dispenser comprising:

a tank defining a cavity in which fluid is supportable;

a pump fluidly connected to the tank and having an inlet and an outlet, wherein fluid is pumpable from the cavity into the pump through the inlet and is pumpable out of the pump through the outlet;

a dispensing tube in fluid connection with the outlet of the pump and being operable to pass fluid therethrough; and a conduit defined in the tank and at least partially passing through the cavity, the dispensing tube being at least partially positioned in the conduit; wherein the conduit extends through a wall of the tank and wherein the conduit extends through walls of the tank on opposite sides of the tank.

27. A portable backpack fluid dispenser operable to dispense fluid, the dispenser comprising:

a tank operable to support fluid therein;

a bracket connected to the tank;

a pump connected to the bracket and including an inlet and an outlet, the pump being operable to pump fluid from the cavity into the inlet and pump fluid out of the pump through the outlet; and a cover selectively connectable to the bracket and being operable to substantially cover the pump when connected to the bracket, wherein the bracket includes a first portion mounted to the tank and a second portion extending at an angle with respect to the first portion, wherein the bracket includes a first flange extending from the second portion of the bracket and a second flange extending from the first portion of the bracket, the cover fastened at one end to one of the first and second flanges and retained at another end to another of the first and second flanges.

28. A portable backpack fluid dispenser operable to dispense fluid, the dispenser comprising:

a tank operable to support fluid therein;

a bracket connected to the tank;

a pump connected to the bracket and including an inlet and an outlet, the pump being operable to pump fluid from the cavity into the inlet and pump fluid out of the pump through the outlet;

a cover selectively connectable to the bracket and being operable to substantially cover the pump when connected to the bracket; and a control circuit for controlling operation of the dispenser, the bracket having a flange onto which the control circuit is mounted.

29. A portable backpack fluid dispenser operable to dispense fluid, the dispenser comprising:

a tank operable to support fluid therein;

a bracket connected to the tank;

a pump connected to the bracket and including an inlet and an outlet, the pump being operable to pump fluid from the cavity into the inlet and pump fluid out of the pump through the outlet; and a cover selectively connectable to the bracket and being operable to substantially cover the pump when connected to the bracket;

the flange supporting a user manipulatable control.

30. A method of assembling a portable backpack fluid dispenser operable to dispense fluid, the method comprising:

providing a tank operable to support fluid therein;

connecting a bracket to the tank;

connecting a pump to, the pump being supportable by the bracket and being operable to pump fluid from the tank;

connecting a cover to the bracket, the cover being operable to at least partially cover the pump when connected to the bracket;

mounting a first portion of the bracket to the tank; and mounting the pump to a flange extending from a second portion of the bracket oriented at an angle with respect to the first portion of the tank.

* * * * *